US009997139B2

(12) United States Patent
Lee et al.

(10) Patent No.: US 9,997,139 B2
(45) Date of Patent: Jun. 12, 2018

(54) METHOD OF CONTROLLING AN OUTPUT VOLTAGE, OUTPUT VOLTAGE CONTROLLING APPARATUS FOR PERFORMING THE METHOD AND DISPLAY APPARATUS HAVING THE OUTPUT VOLTAGE CONTROLLING APPARATUS

(71) Applicant: SAMSUNG DISPLAY CO., LTD., Yongin, Gyeonggi-do (KR)

(72) Inventors: Yong-Soon Lee, Asan-si (KR); Mi-Kyung Kang, Ulsan (KR); Yong-Sik Hwang, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 239 days.

(21) Appl. No.: 14/516,920

(22) Filed: Oct. 17, 2014

(65) Prior Publication Data

US 2015/0206508 A1 Jul. 23, 2015

(30) Foreign Application Priority Data

Jan. 21, 2014 (KR) ..... 10-2014-0007243

(51) Int. Cl.

| | |
|---|---|
| ***G09G 5/18*** | (2006.01) |
| ***G05F 5/00*** | (2006.01) |
| ***G09G 3/36*** | (2006.01) |

(52) U.S. Cl.

CPC ..... *G09G 5/18* (2013.01); *G05F 5/00* (2013.01); *G09G 3/3648* (2013.01); *G09G 3/3696* (2013.01); *G09G 2330/04* (2013.01); *G09G 2330/12* (2013.01); *G09G 2370/08* (2013.01)

(58) Field of Classification Search

None

See application file for complete search history.

(56) References Cited

U.S. PATENT DOCUMENTS

| | | | | |
|---|---|---|---|---|
| 7,443,641 | B2 | 10/2008 | Suzuki | |
| 8,174,802 | B2 | 5/2012 | Abe | |
| 2009/0109158 | A1* | 4/2009 | Shirai | G09G 3/3655 345/94 |

(Continued)

FOREIGN PATENT DOCUMENTS

| | | |
|---|---|---|
| JP | 06-339233 | 12/1994 |
| JP | 2005-328589 | 11/2005 |

(Continued)

*Primary Examiner* — Tony N Ngo

(74) *Attorney, Agent, or Firm* — F. Chau & Associates, LLC

(57) ABSTRACT

A method of controlling an output voltage of an apparatus is provided. The method includes comparing an input voltage of the apparatus with a reference voltage, activating the output voltage when the input voltage is greater than or equal to the reference voltage, comparing the input voltage with a first low limit voltage or a first high limit voltage, comparing a first elapse time with a reference time when the input voltage is less than or equal to the first low limit voltage, comparing a second elapse time with the reference time when the input voltage is greater than or equal to the first high limit voltage, and deactivating the output voltage when the first elapse time or the second elapse time is longer than or equal to the reference time.

19 Claims, 20 Drawing Sheets

(56) References Cited

U.S. PATENT DOCUMENTS

| | | | | |
|---|---|---|---|---|
| 2009/0303641 | A1* | 12/2009 | Abe | H02M 1/32<br>361/18 |
| 2013/0176005 | A1 | 7/2013 | Jin et al. | |

FOREIGN PATENT DOCUMENTS

| | | |
|---|---|---|
| JP | 2006-040651 | 2/2006 |
| KR | 1020110119150 | 11/2011 |

* cited by examiner

METHOD OF CONTROLLING AN OUTPUT VOLTAGE, OUTPUT VOLTAGE CONTROLLING APPARATUS FOR PERFORMING THE METHOD AND DISPLAY APPARATUS HAVING THE OUTPUT VOLTAGE CONTROLLING APPARATUS

CROSS-REFERENCE TO RELATED PATENT APPLICATION

This application claims priority under 35 U.S.C. § 119 to Korean Patent Application No. 10-2014-0007243, filed on Jan. 21, 2014 in the Korean Intellectual Property Office (KIPO), the disclosure of which is incorporated by reference herein in its entirety.

TECHNICAL FIELD

The present inventive concept relates to a display apparatus, more particularly, a method of controlling an output voltage, an output voltage controlling apparatus for performing the method, and a display apparatus including the output voltage controlling apparatus.

DISCUSSION OF THE RELATED ART

A display apparatus includes a display panel, a gate driving part, a data driving part, and a timing controlling part. The display apparatus further includes a power supplying part for supplying power voltages to the gate driving part, the data driving part, and the timing controlling part. The power supplying part may deactivate the power voltages when the input voltage from outside thereof becomes less than a predetermined voltage to protect the gate driving part, the data driving part, and the timing controlling part from being damaged due to instability of the power supplying part.

SUMMARY

According to an exemplary embodiment of the present inventive concept, a method of controlling an output voltage of an apparatus is provided. The method includes comparing an input voltage of the apparatus with a reference voltage, activating the output voltage when the input voltage is greater than or equal to the reference voltage, comparing the input voltage with a first low limit voltage or a first high limit voltage greater than the first low limit voltage, comparing a first elapse time with a reference time when the input voltage is less than or equal to the first low limit voltage, comparing a second elapse time with a reference time when the input voltage is greater than or equal to the first high limit voltage, and deactivating the output voltage when the first elapse time or the second elapse time is longer than or equal to the reference time. The first elapse time is an amount of the input voltage is less than or equal to the first low limit voltage. The second elapse time is an amount of time the input voltage is greater than or equal to the first high limit voltage. In one embodiment, the method may further include maintaining the activation of the output voltage when the input voltage is greater than the first low limit voltage and less than the first high limit voltage.

In one embodiment, the method may further include deactivating the output voltage when the input voltage is less than or equal to a second low limit voltage less than the first low limit voltage.

In one embodiment, the method may further include comparing a third elapse time with the reference time when the input voltage is greater than the second low limit voltage and deactivating the output voltage when the third elapse time is longer than or equal to the reference time. The third elapse time may be an amount of time the input voltage is greater than the second low limit voltage, and less than or equal to the first low limit voltage.

In one embodiment, the method may further include maintaining the activation of the output voltage when the third elapse time is less than the reference time.

In one embodiment, the method may further include deactivating the output voltage when the input voltage is greater than or equal to a second high limit voltage greater than the first high limit voltage.

In one embodiment, the method may further include comparing a fourth elapse time with the reference time when the input voltage is less than the second high limit voltage, and greater than or equal to the first high limit voltage, and deactivating the output voltage when the fourth elapse time is longer than or equal to the reference time. The fourth elapse time may be an amount of time the input voltage is less than the second high limit voltage, and greater than or equal to the first high limit voltage.

In one embodiment, the method may further include maintaining the activation of the output voltage when the fourth elapse time is less than the reference time.

In one embodiment, the method may further include maintaining the activation of the output voltage when the first elapse time or the second elapse time is less than the reference time.

In one embodiment, the method may further include maintaining the deactivation of the output voltage when the input voltage is less than the reference voltage.

In one embodiment, the output voltage may include at least one of a first power voltage, a second power voltage, a third power voltage, a gate on and off voltages, and an analog voltage. The first power voltage may be used for driving a gate driving part configured to output a gate signal to a gate line of a display panel. The second power voltage may be used for driving a data driving part configured to output a data signal to a data line of the display panel. The third power voltage may be used for driving a timing controlling part configured to output a gate control signal and a data control signal. The gate control signal may be used for controlling the gate driving part. The data control signal may be used for controlling the data driving part. The gate on and off voltages may be applied to the gate driving part to generate the gate signal. The analog voltage may be applied to the data driving part to generate the data signal.

According to an exemplary embodiment of the present inventive concept, an output voltage controlling apparatus is provided. The output voltage controlling apparatus includes a first comparing part, a second comparing part, and an output voltage generating part. The first comparing part is configured to compare an input voltage of the output voltage controlling apparatus with a reference voltage. The second comparing part is configured to compare the input voltage with a first low limit voltage or a first high limit voltage when the input voltage is greater than or equal to the reference voltage. The second comparing part is configured to compare a first elapse time with a reference time when the input voltage is less than or equal to the first low limit voltage. The second comparing part is configured to compare a second elapse time with a reference time when the input voltage is greater than or equal to the first high limit voltage. The output voltage generating part is configured to activate the output voltage when the input voltage is greater than or equal to the reference voltage and to deactivate the output voltage when the first elapse time or the second elapse time is longer than or equal to the reference time. The first elapse time is an amount of time the input voltage is less than or equal to the first low limit voltage. The second elapse time is an amount of time the input voltage is greater than or equal to the first low limit voltage.

In one embodiment, the second comparing part may include a voltage comparing part, a time comparing part, a second comparison signal generating part. The voltage comparing part may be configured to compare the input voltage with the first low limit voltage. The time comparing part may be configured to compare the first elapse time with the reference time. The second comparison signal generating part may be configured to output a comparison signal based on an output signal of the voltage comparing part and an output signal of the time comparing part.

In one embodiment, the second comparing part may include a first voltage comparing part, a second voltage comparing, a time comparing part, and a second comparison signal generating part. The first voltage comparing part may be configured to compare the input voltage with the first low limit voltage. The second voltage comparing part may be configured to compare the input voltage with a second low limit voltage less than the first low limit voltage when the input voltage is less than or equal to the first low limit voltage. The time comparing part may be configured to compare a third elapse time with the reference time when the input voltage is less than or equal to the first low limit voltage, and is greater than the second low limit voltage. The second comparison signal generating part may be configured to output a comparison signal based on output signals of the first and second voltage comparing parts, and an output signal of the time comparing part.

In one embodiment, the second comparing part may include a voltage comparing part, a time comparing part, and a second comparison signal generating part. The voltage comparing part may be configured to compare the input voltage with the first high limit voltage. The time comparing part may be configured to compare the second elapse time with the reference time when the input voltage is greater than or equal to the first high limit voltage. The second comparison signal generating part may be configured to output a comparison signal based on an output signal of the voltage comparing part and an output signal of the time comparing part.

In one embodiment, the second comparing part may include a first voltage comparing part, a second voltage comparing part, a time comparing part, and a second comparison signal generating part. The first voltage comparing part may be configured to compare the input voltage with the first low limit voltage. The second voltage comparing part may be configured to compare the input voltage with a second high limit voltage greater than the first high limit voltage when the input voltage is greater than or equal to the first low limit voltage. The time comparing part may be configured to compare a fourth elapse time with the reference time when the input voltage is greater than or equal to the first high limit voltage, and is less than the second high limit voltage. The second comparison signal generating part may be configured to output a comparison signal based on output signals of the first and second voltage comparing parts, and an output signal of the time comparing part. The fourth elapse time may be an amount of time the input voltage is greater than or equal to the first high limit voltage, and less than the second high limit voltage.

In one embodiment, the output voltage generating part may be configured to maintain the activation of the output voltage when the first elapse time or the second elapse time is less than the reference time.

According to an exemplary embodiment of the present inventive concept, a display apparatus is provided. The display apparatus includes a display panel, a gate driving part, a data driving part, a timing controlling part, and an output voltage controlling apparatus. The display panel is configured to display an image, and includes a gate line and a data line. The gate driving part is configured to output a gate signal to the gate line. The data driving part is configured to output a data signal to the data line. The timing controlling part is configured to output a gate control signal for controlling the gate driving part and a data control signal for controlling the data driving part. The output voltage controlling apparatus includes a first comparing part, a second comparing part, and an output voltage generating part. The first comparing part is configured to compare an input voltage of the output voltage controlling apparatus with a reference voltage, a second comparing part configured to compare the input voltage with a first low limit voltage a first high limit voltage when the input voltage is greater than or equal to the reference voltage. The second comparing part is configured to compare a first elapse time with a reference time when the input voltage is less than or equal to the first low limit voltage. The second comparing part is configured to compare a second elapse time with the reference time when the input voltage is greater than or equal to the first high limit voltage. The output voltage generating part is configured to activate the output voltage when the input voltage is greater than or equal to the reference voltage, and to deactivate the output voltage when the first elapse time or the second elapse time is longer than or equal to the reference time. The first elapse time is an amount of time the input voltage is less than or equal to the first low limit voltage, and the second elapse time is an amount of time the input voltage is greater than or equal to the first low limit voltage.

In one embodiment, the output voltage generating part may be configured to maintain the activation of the output voltage when the first elapse time or the second elapse time is less than the reference time.

According to an exemplary embodiment of the present inventive concept, a method of controlling an output voltage of an apparatus is provided. The method includes comparing an input voltage to the apparatus with a reference voltage, activating the output voltage when the input voltage is greater than or equal to the reference voltage, maintaining the activation of the output voltage when the input voltage is in a predetermined range, comparing an elapse time with a reference time when the input voltage is out of the predetermined range, and deactivating the output voltage when the elapse time is longer than or equal to the reference time. The elapse time is an amount of time the input voltage is out of the predetermined range.

BRIEF DESCRIPTION OF THE DRAWINGS

The above and other features of the present inventive concept will become more apparent by describing in detailed exemplary embodiments thereof with reference to the accompanying drawings of which.

DETAILED DESCRIPTION OF THE INVENTIVE CONCEPT

Hereinafter, the present inventive concept will be explained in detail with reference to the accompanying drawings.

Figure 1:
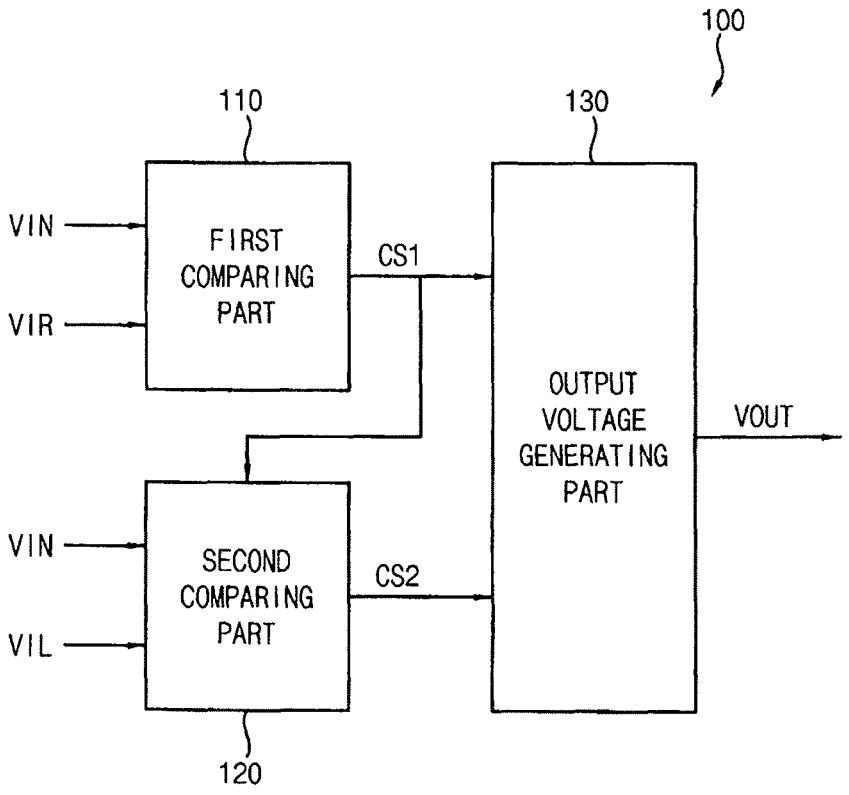
FIG. 1 is a block diagram illustrating an output voltage controlling apparatus according to an exemplary embodiment of the present inventive concept.

FIG. 1 is a block diagram illustrating an output voltage controlling apparatus according to an exemplary embodiment of the present inventive concept.

Referring to FIG. 1, the output voltage controlling apparatus 100 according to the exemplary embodiment of the present inventive concept includes a first comparing part 110, a second comparing part 120, and an output voltage generating part 130.

The first comparing part 110 compares an input voltage VIN applied from outside with a predetermined reference voltage VIR to output a first comparison signal CS1. For example, the first comparison signal CS1 may have a low level when the input voltage VIN is less than the reference voltage VIR, and the first comparison signal CS1 may have a high level when the input voltage VIN is greater than or equal to the reference voltage VIR. In addition, the first comparison signal CS1 may have a high level when the input voltage VIN is less than the reference voltage VIR, and the first comparison signal CS1 may have a low level when the input voltage VIN is greater than or equal to the reference voltage VIR.

The second comparing part 120 compares the input voltage VIN with a low limit voltage VIL to output a second comparison signal CS2 when the input voltage VIN is greater than or equal to the reference voltage VIR according to the first comparison signal CS1. In addition, the second comparing part 120 compares an elapse time with a reference time RT to output the second comparison signal CS2 when the input voltage VIN is less than or equal to the low limit voltage VIL. For example, the elapse time may be a time that has elapsed since the input voltage VIN became less than or equal to the low limit voltage VIL.

Figure 2:
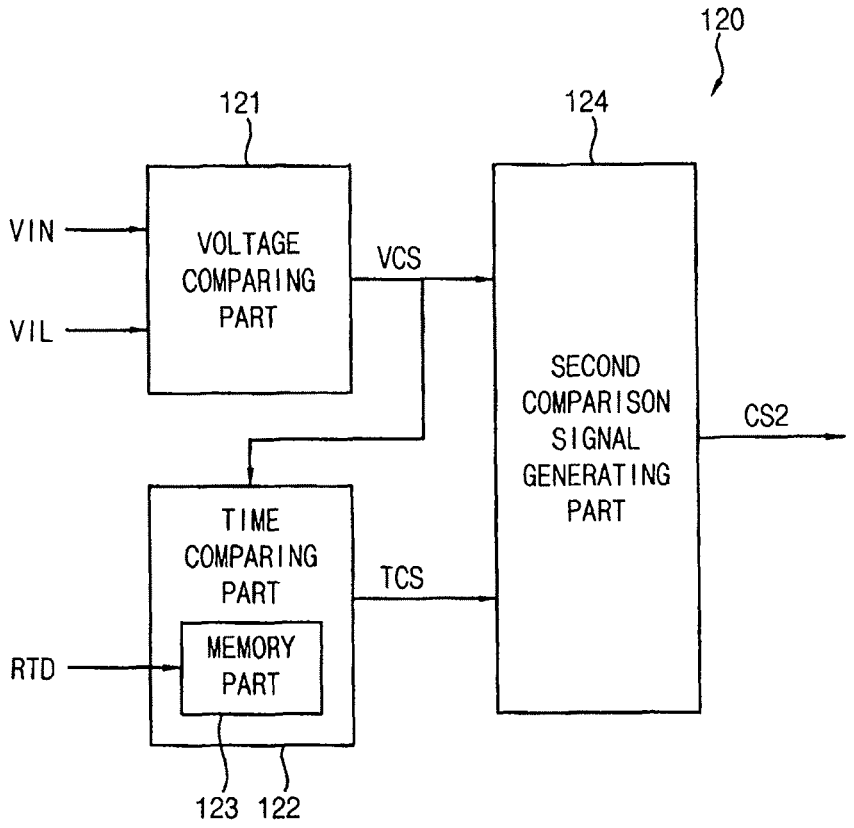
FIG. 2 is a block diagram illustrating a second comparing part of FIG. 1.

FIG. 2 is a block diagram illustrating the second comparing part 120 of FIG. 1. Referring to FIGS. 1 and 2, the second comparing part 120 includes a voltage comparing part 121, a time comparing part 122 and a second comparison signal generating part 124.

The voltage comparing part 121 compares the input voltage VIN with the low limit voltage VIL to output a voltage comparison signal VCS. For example, the voltage comparison signal VCS may have a high level when the input voltage VIN is greater than the low limit voltage VIL, and the voltage comparison signal VCS may have a low level when the input voltage VIN is less than or equal to the low limit voltage VIL. In addition, the voltage comparison signal VCS may have a low level when the input voltage VIN is greater than the low limit voltage VIL, and the voltage comparison signal VCS may have a high level when the input voltage VIN is less than or equal to the low limit voltage VIL.

The time comparing part 122 compares the elapse time with the reference time RT to output a time comparison signal TCS, when the input voltage VIN is less than or equal to the low limit voltage VIL according to the voltage comparison signal VCS. For example, the time comparison signal TCS may have a low level when the elapse time is longer than or equal to the reference time RT, and the time comparison signal TCS may have a high level when the elapse time is less than the reference time RT. In addition, the time comparison signal TCS may a have high level when the elapse time is longer than or equal to the reference time RT, and the time comparison signal TCS may have a low level when the elapse time is less than the reference time RT.

The time comparing part 122 may further include a memory part 123 for storing a reference time data RTD which is data of the reference time RT. For example, the memory part 123 may be an electrically erasable programmable read only memory (EEPROM). The reference time data RTD may be stored in the memory part 123 with 2 bits. For example, the reference time data RTD may be '00' when the reference time RT is about 0 μs, the reference time data RTD may be '01' when the reference time RT is about 10 μs, the reference time data RTD may be '10' when the reference time RT is about 50 μs, and the reference time data RTD may be '11' when the reference time RT is about 100 μs.

The second comparison signal generating part 124 generates the second comparison signal CS2 according to the voltage comparison signal VCS and the time comparison signal TCS. For example, the second comparison signal CS2 may have a high level when the voltage comparison signal VCS has a high level. In addition, the second comparison signal CS2 may have a high level when the voltage comparison signal VCS has a low level and the time comparison signal TCS has a high level. In addition, the second comparison signal CS2 may have a low level when the voltage comparison signal VCS has a low level and the time comparison signal TCS has a low level.

Referring back to FIG. 1, the output voltage generating part 130 generates an output voltage VOUT according to the first comparison signal CS1 and the second comparison signal CS2. For example, the output voltage generating part 130 activates the output voltage VOUT when the input voltage VIN is greater than or equal to the reference voltage VIR according to the first comparison signal CS1. In addition, the output voltage generating part 130 maintains an activation of the output voltage VOUT when the input voltage VIN is greater than the low limit voltage VIL according to the second comparison signal CS2. In addition, the output voltage generating part 130 maintains the activation of the output voltage VOUT when the input voltage VIN is less than or equal to the low limit voltage VIL and the elapse time is less than the reference time RT according to the second comparison signal CS2. In addition, the output voltage generating part 130 deactivates the output voltage VOUT when the input voltage VIN is less than or equal to the low limit voltage VIL and the elapse time is greater than or equal to the reference time RT according to the second comparison signal CS2.

Figure 3:
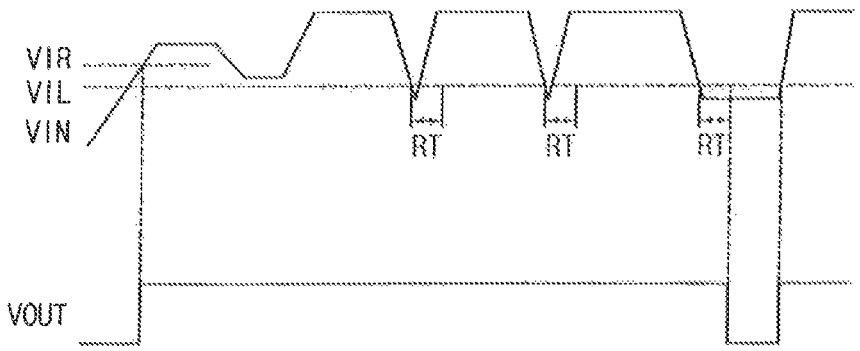
FIG. 3 is a waveform diagram illustrating an input voltage, a reference voltage, a low limit voltage, and an output voltage of FIGS. 1 and 2.

FIG. 3 is a waveform diagram illustrating the input voltage VIN, the reference voltage VIR, the low limit voltage VIL, and the output voltage VOUT of FIGS. 1 and 2.

Referring to FIGS. 1 to 3, when the input voltage VIN is greater than or equal to the reference voltage VIR, the output voltage VOUT is activated. The input voltage VIN and the reference voltage VIR may be compared by the first comparing part 110. In addition, the output voltage VOUT may be activated by the output voltage generating part 130. When the input voltage VIN is less than the reference voltage VIR, a deactivation of the output voltage VOUT is maintained. The deactivation of the output voltage VOUT may be maintained by the output voltage generating part 130.

After the output voltage VOUT is activated, when the input voltage VIN is greater than the low limit voltage VIL, the activation of the output voltage VOUT is maintained. The input voltage VIN and the low limit voltage VIL may be compared by the voltage comparing part 121 of the second comparing part 120. In addition, the activation of the output voltage VOUT may be maintained by the output voltage generating part 130.

After the output voltage VOUT is activated, when the input voltage VIN is smaller or equal toless than or equal to the low limit voltage VIL, the elapse time and the reference time RT are compared. When the elapse time is less than the reference time RT, the activation of the output voltage VOUT is maintained. The elapse time and the reference time RT may be compared by the time comparing part 122 of the second comparing part 120. In addition, the activation of the output voltage VOUT may be maintained by the output voltage generating part 130. When the elapse time is longer than or equal to the reference time RT, the output voltage VOUT is deactivated. The output voltage VOUT may be deactivated by the output voltage generating part 130.

Figure 4:
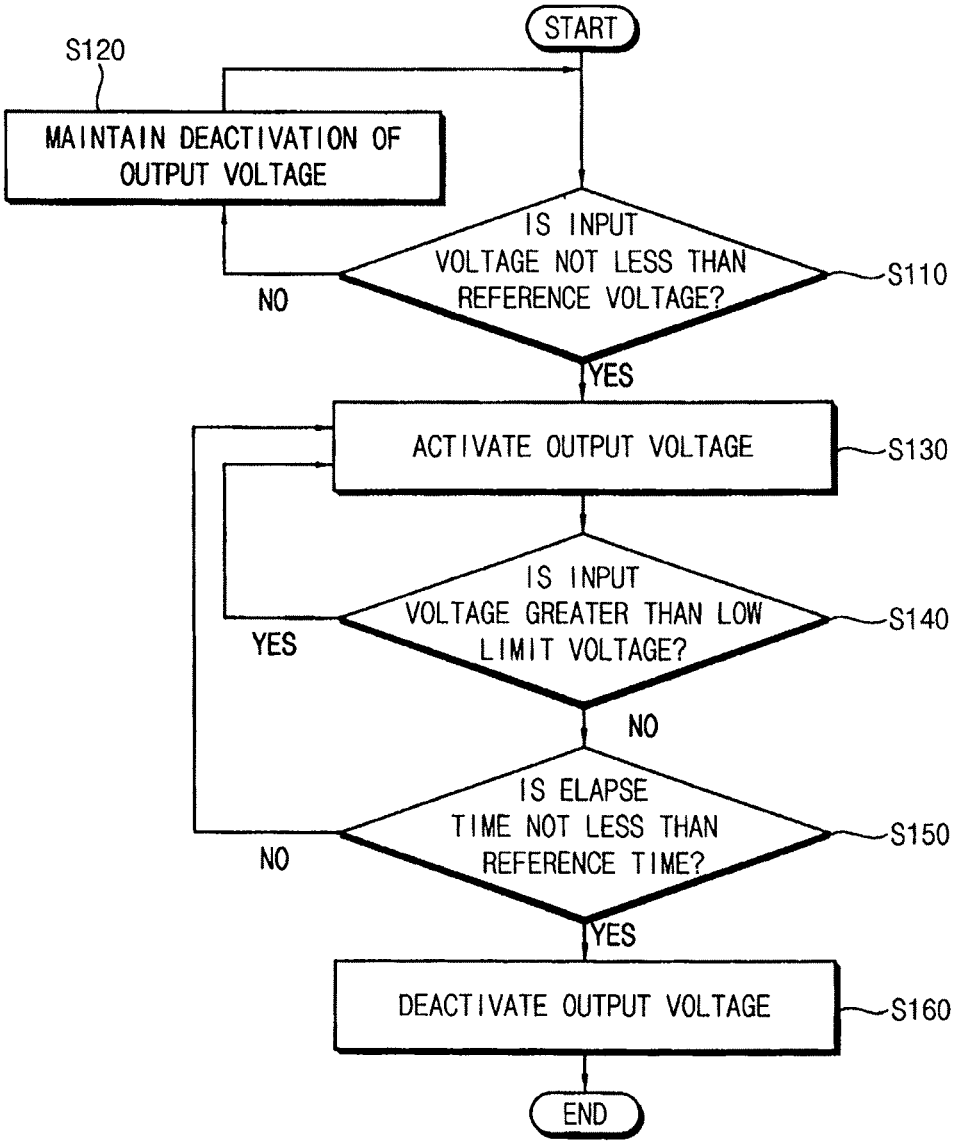
FIG. 4 is a flow chart illustrating a method of controlling output voltage by using the output voltage controlling apparatus of FIG. 1.

FIG. 4 is a flow chart illustrating a method of controlling an output voltage VOUT by using the output voltage controlling apparatus 100 of FIG. 1.

Referring to FIGS. 1 to 4, it is determined that the input voltage VIN is greater than or equal to the reference voltage VIR (step S110). For example, the first comparing part 110 compares the input voltage VIN with the reference voltage VIR to output the first comparison signal CS1.

When the input voltage VIN is less than the reference voltage VIR, the deactivation of the output voltage VOUT is maintained (step S120). For example, the output voltage generating part 130 maintains the deactivation of the output voltage VOUT according to the first comparison signal CS1. The deactivation of the output voltage VOUT is maintained until the input voltage VIN becomes greater than or equal to the reference voltage VIR.

When the input voltage VIN is greater than or equal to the reference voltage VIR, the output voltage VOUT is activated (step S130). For example, the output voltage generating part 130 activates the output voltage VOUT according to the first comparison signal CS1.

It is determined that the input voltage VIN is greater than the low limit voltage VIL (step S140). For example, the voltage comparing part 121 of the second comparing part 120 compares the input voltage VIN with the low limit voltage VIL to output the voltage comparison signal VCS.

When the input voltage VIN is greater than the low limit voltage VIL, the output voltage VOUT is activated (step S130). For example, when the input voltage VIN is greater than the low limit voltage VIL, the activation of the output voltage VOUT is maintained, and the output voltage generating part 130 maintains the activation of the output voltage VOUT according to the second comparison signal CS2 generated based on the voltage comparison signal VCS.

When the input voltage VIN is less than or equal to the low limit voltage VIL, it is determined that the elapse time is greater than or equal to the reference time RT (step S150). For example, the time comparing part 122 of the second comparing part 120 compares the elapse time with the reference time RT to output the time comparison signal TCS when the input voltage VIN is less than or equal to the low limit voltage VIL according to the voltage comparison signal VCS.

When the elapse time is less than the reference time RT, the output voltage VOUT is activated (step S130). For example, when the elapse time is less than the reference time RT, the activation of the output voltage VOUT is maintained, and the output voltage generating part 130 maintains the activation of the output voltage VOUT according to the second comparison signal CS2 generated based on the time comparison signal TCS.

When the elapse time is greater than or equal to the reference time RT, the output voltage VOUT is deactivated (step S160). For example, the output voltage generating part 130 deactivates the output voltage VOUT according to the second comparison signal CS2 generated based on the time comparison signal TCS.

Figure 5:
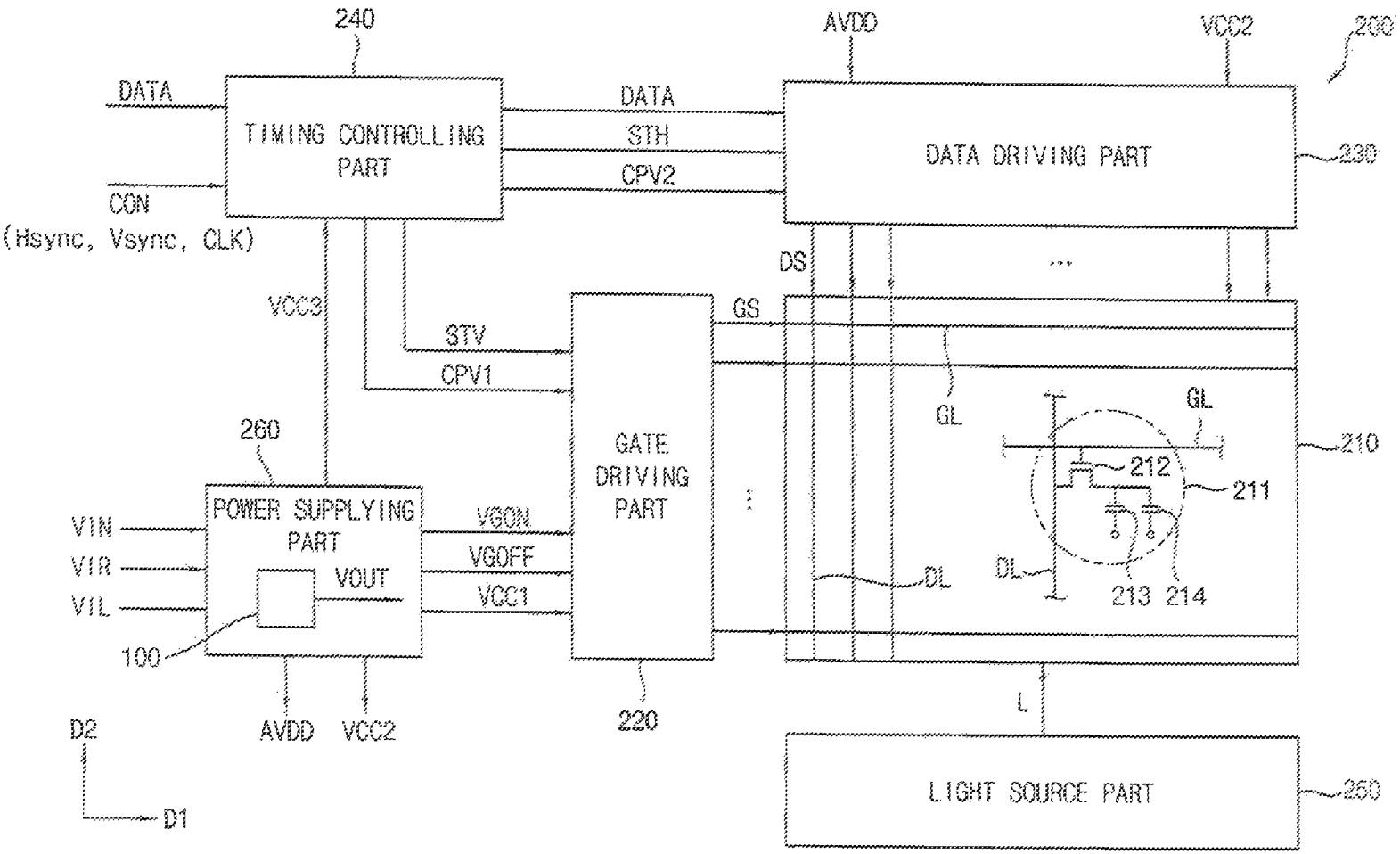
FIG. 5 is a block diagram illustrating a display apparatus including the output voltage controlling apparatus of FIG. 1.

FIG. 5 is a block diagram illustrating a display apparatus including the output voltage controlling apparatus 100 of FIG. 1.

Referring to FIGS. 1 and 5, the display apparatus 200 according to the exemplary embodiment of the present inventive concept includes a display panel 210, a gate driving part 220, a data driving part 230, a timing controlling part 240, a light source part 250, and a power supplying part 260.

The display panel 210 receives a data signal DS based on an image data DATA provided from outside to display an image. For example, the image data DATA may be two-dimensional (2D) plane image data. In addition, the image data DATA may include a left-eye image data and a right-eye image data for displaying a three-dimensional (3D) stereoscopic image.

The display panel 210 includes gate lines GL, data lines DL, and a plurality of pixels 211. The gate lines GL extend in a first direction D1 and the data lines DL extend in a second direction D2 substantially perpendicular to the first direction D1. The first direction D1 may be substantially parallel with a long side of the display panel 210, and the second direction D2 may be substantially parallel with a short side of the display panel 210. Each of the pixels 221 includes a thin film transistor 212 electrically connected to each of the gate lines GL and each of the data lines DL, a liquid crystal capacitor 213, and a storage capacitor 214 connected to the thin film transistor 212.

The gate driving part 220 generates a gate signal GS in response to a gate start signal STV, a first gate clock signal CPV1 provided from the timing controlling part 240, and outputs the gate signal GS to the gate lines GL.

The data driving part 230 outputs the data signal DS based on the image data DATA to the data lines DL in response to a data start signal STH and a data clock signal CPV2 provided from the timing controlling part 240.

The light source part 250 provides light L to the display panel 210. For example, the light source part 250 may include a light emitting diode (LED).

The timing controlling part 240 receives the image data DATA and a control signal CON from outside. The control signal CON may include a horizontal synchronous signal Hsync, a vertical synchronous signal Vsync, and a clock signal CLK. The timing controlling part 240 generates the data start signal STH by using the horizontal synchronous signal Hsync and outputs the data start signal STH to the data driving part 230. In addition, the timing controlling part 240 generates the gate start signal STV by using the vertical synchronous signal Vsync and outputs the gate start signal STV to the gate driving part 220. In addition, the timing controlling part 240 generates the gate clock signal CPV1 and the data clock signal CPV2 by using the clock signal CLK, outputs the gate clock signal CPV1 to the gate driving part 220, and outputs the data clock signal CPV2 to the data driving part 230.

The power supplying part 260 includes the output voltage controlling apparatus 100 of FIG. 1. Thus, the power supplying part 260 outputs the output voltage VOUT according to the input voltage VIN, the reference voltage VIR, and the low limit voltage VIL. For example, the reference voltage VIR may be about 2.3 volt (V), and the low limit voltage VIL may be about 2.0 V.

The output voltage VOUT may include at least one of a first power voltage VCC1, a second power voltage VCC2, a third power voltage VCC3, a gate on voltage VGON, a gate off voltage VGOFF, and an analog voltage AVDD. The first power voltage VCC1 drives the gate driving part 220. The second power voltage VCC2 drives the data driving part 230. The third power voltage VCC3 drives the timing controlling part 240. The gate on voltage VGON and the gate off voltage VGOFF are applied to the gate driving part 220, and the gate driving part 220 generates the gate signal GS by using the gate on voltage VGON and the gate off voltage VGOFF. The analog voltage AVDD is applied to the data driving part 230, and the data driving part 230 generates the data signal DS by using the analog voltage AVDD.

The input voltage VIN may be less than or equal to the low limit voltage VIL in a frame period. For example, the input voltage VIN may be less than or equal to the low limit voltage VIL in response to the gate start signal STV that is applied to the gate driving part 220 in the frame period. In this case, the input voltage VIN may be less than or equal to the low limit voltage VIL during a time less than the reference time RT. In addition, the input voltage VIN may be less than or equal to the low limit voltage VIL due to instability of the output voltage controlling apparatus 100 or the power supplying part 260. In this case, the input voltage VIN may be less than or equal to the low limit voltage VIL during a time longer than or equal to the reference time RT.

According to the exemplary embodiment of the present inventive concept, although the input voltage VIN is less than or equal to the low limit voltage VIL, when the elapse time is less than the reference time RT, the activation of the output voltage VOUT is maintained, and thus display quality of the display apparatus 200 may be increased. For example, the elapse time may be a time that has elapsed since the input voltage VIN became less than or equal to the low limit voltage VIL.

Figure 6:
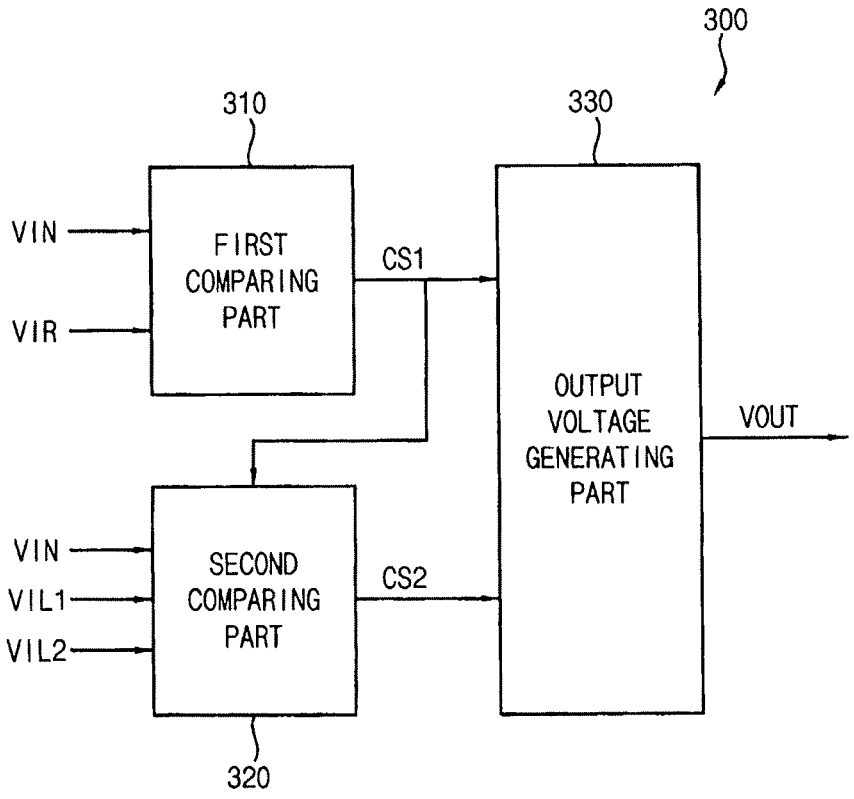
FIG. 6 is a block diagram illustrating an output voltage controlling apparatus according to an exemplary embodiment of the present inventive concept.

FIG. 6 is a block diagram illustrating an output voltage controlling apparatus according to an exemplary embodiment of the present inventive concept.

Referring to FIG. 6, the output voltage controlling apparatus 300 according to the exemplary embodiment of the present inventive concept includes a first comparing part 310, a second comparing part 320, and an output voltage generating part 330.

The first comparing part 310 compares an input voltage VIN applied from outside with a predetermined reference voltage VIR to output a first comparison signal CS1. For example, the first comparison signal CS1 may have a low level when the input voltage VIN is less than the reference voltage VIR, and the first comparison signal CS1 may have a high level when the input voltage VIN is greater than or equal to the reference voltage VIR. In addition, the first comparison signal CS1 may have a high level when the input voltage VIN is less than the reference voltage VIR, and the first comparison signal CS1 may have a low level when the input voltage VIN is greater than or equal to the reference voltage VIR.

The second comparing part 320 compares the input voltage VIN with a first low limit voltage VIL1 and compares the input voltage VIN with a second low limit voltage VIL2 to output a second comparison signal CS2 when the input voltage VIN is greater than or equal to the reference voltage VIR according to the first comparison signal CS1. The second low limit voltage VIL2 is less than the first low limit voltage VIL1. In addition, the second comparing part 320 compares an elapse time with a reference time RT to output the second comparison signal CS2 when the input voltage VIN is less than or equal to the first low limit voltage VIL1 and is greater than the second low limit voltage VIL2. For example, the elapse time may be a time that has elapsed since the input voltage VIN became less than or equal to the first low limit voltage VIL1 and greater than the second low limit voltage VIL2.

Figure 7:
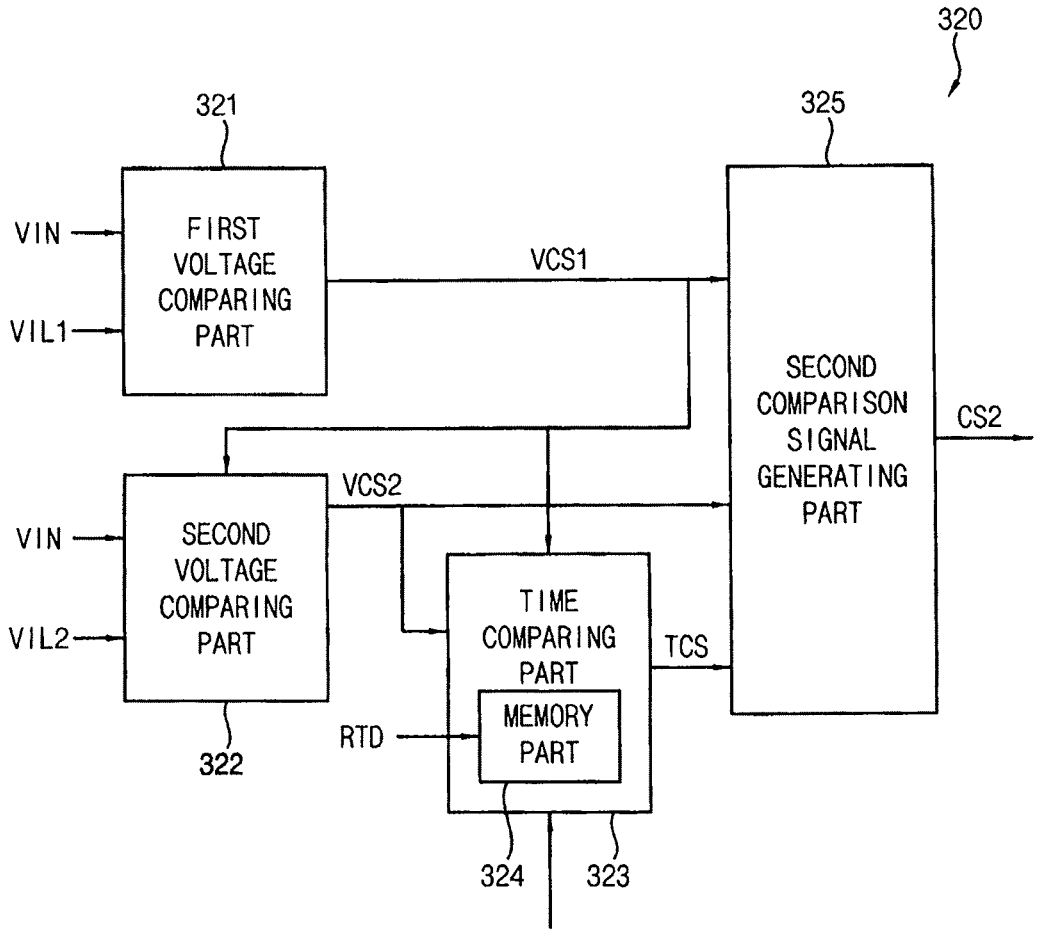
FIG. 7 is a block diagram illustrating a second comparing part of FIG. 6.

FIG. 7 is a block diagram illustrating the second comparing part 320 of FIG. 6.

Referring to FIGS. 6 and 7, the second comparing part 320 includes a first voltage comparing part 321, a second voltage comparing part 322, a time comparing part 323, and a second comparison signal generating part 325.

The first voltage comparing part 321 compares the input voltage VIN with the first low limit voltage VIL1 to output a first voltage comparison signal VCS1. For example, the first voltage comparison signal VCS1 may have a high level when the input voltage VIN is greater than the first low limit voltage VIL1, and the first voltage comparison signal VCS1 may have a low level when the input voltage VIN is less than or equal to the first low limit voltage VIL1. In addition, the first voltage comparison signal VCS1 may have a low level when the input voltage VIN is greater than the first low limit voltage VIL1, and the first voltage comparison signal VCS1 may have a high level when the input voltage VIN is less than or equal to the first low limit voltage VIL1.

The second voltage comparing part 322 compares the input voltage VIN with the second low limit voltage VIL2 to output a second voltage comparison signal VCS2 when the input voltage VIN is less than or equal to the first low limit voltage VIL1 according to the first voltage comparison signal VCS1. For example, the second voltage comparison signal VCS2 may have a high level when the input voltage VIN is greater than the second low limit voltage VIL2, and the second voltage comparison signal VCS2 may have a low level when the input voltage VIN is less than or equal to the second low limit voltage VIL2. In addition, the second voltage comparison signal VCS2 may have a low level when the input voltage VIN is greater than the second low limit voltage VIL2, and the second voltage comparison signal VCS2 may have a high level when the input voltage VIN is less than or equal to the second low limit voltage VIL2.

The time comparing part 323 compares the elapse time with the reference time RT to output a time comparison signal TCS when the input voltage VIN is less than or equal to the first low limit voltage VIL1 and is greater than the second low limit voltage VIL2 according to the first voltage comparison signal VCS1 and the second voltage comparison signal VCS2. For example, the elapse time may be a time that has elapsed since the input voltage VIN became less than or equal to the first low limit voltage VIL1 and greater than the second low limit voltage VIL2. For example, the time comparison signal TCS may have a low level when the elapse time is longer than or equal to the reference time RT, and the time comparison signal TCS may have a high level when the elapse time is less than the reference time RT. In addition, the time comparison signal TCS may have a high level when the elapse time is longer than or equal to the reference time RT, and the time comparison signal TCS may have a low level when the elapse time is less than the reference time RT.

The time comparing part 323 may further include a memory part 324 for storing a reference time data RTD which is data of the reference time RT. For example, the memory part 324 may be an electrically erasable programmable read only memory (EEPROM). The reference time data RTD may be stored in the memory part 324 with 2 bits. For example, the reference time data RTD may be '00' when the reference time RT is about 0 the reference time data RTD may be '01' when the reference time RT is about 10 μs, the reference time data RTD may be '10' when the reference time RT is about 50 μs, and the reference time data RTD may be '11' when the reference time RT is about 100 μs.

The second comparison signal generating part 325 generates the second comparison signal CS2 according to the first voltage comparison signal VCS1, the second voltage comparison signal VCS2, and the time comparison signal TCS. For example, the second comparison signal CS2 may have a high level when the first voltage comparison signal VCS1 has a high level. In addition, the second comparison signal CS2 may have a low level when the second voltage comparison signal VCS2 has a low level. In addition, the second comparison signal CS2 may have a high level when the first voltage comparison signal VCS1 has a low level, the second voltage comparison signal VCS2 has a high level, and the time comparison signal TCS has a high level. In addition, the second comparison signal CS2 may have a low level, when the first voltage comparison signal VCS1 has a low level, the second voltage comparison signal VCS2 has a high level, and the time comparison signal TCS has a low level.

Referring back to FIG. 6, the output voltage generating part 330 generates an output voltage VOUT according to the first comparison signal CS1 and the second comparison signal CS2. For example, the output voltage generating part 330 activates the output voltage VOUT when the input voltage VIN is greater than or equal to the reference voltage VIR according to the first comparison signal CS1. In addition, the output voltage generating part 330 maintains an activation of the output voltage VOUT when the input voltage VIN is greater than the first low limit voltage VIL1 according to the second comparison signal CS2. In addition, the output voltage generating part 330 maintains the activation of the output voltage VOUT when the input voltage VIN is less than or equal to the first low limit voltage VIL1, the input voltage VIN is greater than the second low limit voltage VIL2, and the elapse time is less than the reference time RT according to the second comparison signal CS2. For example, the elapse time may be a time that has elapsed since the input voltage VIN became less than or equal to the first low limit voltage VIL1, and greater than the second low limit voltage VIL2. In addition, the output voltage generating part 330 deactivates the output voltage VOUT when the input voltage VIN is less than or equal to the first low limit voltage VIL1, the input voltage VIN is greater than the second low limit voltage VIL2 and the elapse time is longer than or equal to the reference time RT according to the second comparison signal CS2. In addition, the output voltage generating part 330 deactivates the output voltage VOUT when the input voltage VIN is less than or equal to the second low limit voltage VIL2 according to the second comparison signal CS2.

Figure 8:
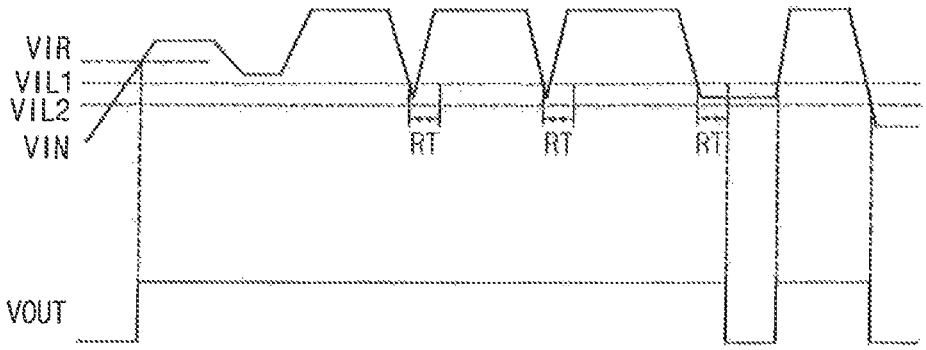
FIG. 8 is a waveform diagram illustrating an input voltage, a reference voltage, a first low limit voltage, a second low limit voltage and an output voltage of FIGS. 6 and 7.

FIG. 8 is a waveform diagram illustrating the input voltage VIN, the reference voltage VIR, the first low limit voltage VIL1, the second low limit voltage VIL2, and the output voltage VOUT of FIGS. 6 and 7.

Referring to FIGS. 6 to 8, when the input voltage VIN is greater than or equal to the reference voltage VIR, the output voltage VOUT is activated. The input voltage VIN and the reference voltage VIR may be compared by the first comparing part 310. In addition, the output voltage VOUT may be activated by the output voltage generating part 330. When the input voltage VIN is less than the reference voltage VIR, a deactivation of the output voltage VOUT is maintained. The deactivation of the output voltage VOUT may be maintained by the output voltage generating part 330.

After the output voltage VOUT is activated, when the input voltage VIN is greater than the first low limit voltage VIL1, the activation of the output voltage VOUT is maintained. The input voltage VIN and the first low limit voltage VIL1 may be compared by the first voltage comparing part 321 of the second comparing part 320. In addition, the activation of the output voltage VOUT may be maintained by the output voltage generating part 330.

After the output voltage VOUT is activated, when the input voltage VIN is less than or equal to the first low limit voltage VIL1 and the input voltage VIN is greater than the second low limit voltage VIL2, the elapse time and the reference time RT are compared. For example, the elapse time may be a time that has elapsed since the input voltage VIN became less than or equal to the first low limit voltage VIL1, and greater than the second low limit voltage VIL2. In addition, when the elapse time is less than the reference time RT, the activation of the output voltage VOUT is maintained. The input voltage VIN and the second low limit voltage VIL2 may be compared by the second voltage comparing part 322 of the second comparing part 320. In addition, the elapse time and the reference time RT may be compared by the time comparing part 322 of the second comparing part 320. In addition, the activation of the output voltage VOUT may be maintained by the output voltage generating part 330. When the elapse time is longer than or equal to the reference time RT, the output voltage VOUT is deactivated. The output voltage VOUT may be deactivated by the output voltage generating part 330.

After the output voltage VOUT is activated, when the input voltage VIN is less than or equal to the second low limit voltage VIL2, the output voltage VOUT is deactivated. The output voltage VOUT may be deactivated by the output voltage generating part 330.

Figure 9:
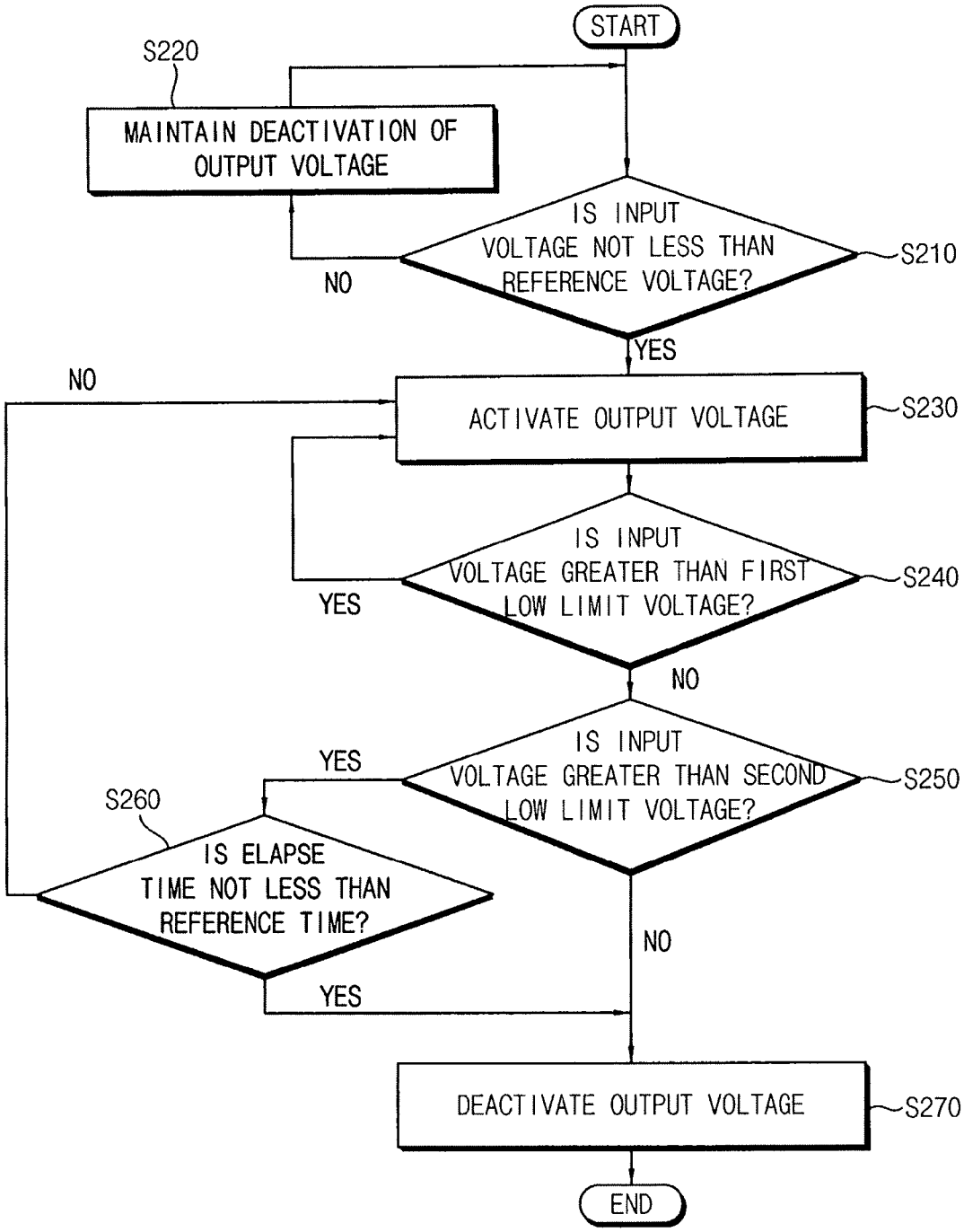
FIG. 9 is a flow chart illustrating a method of controlling an output voltage by using the output voltage controlling apparatus of FIG. 6.

FIG. 9 is a flow chart illustrating a method of controlling an output voltage VOUT by using the output voltage controlling apparatus 300 of FIG. 6.

Referring to FIGS. 6 to 9, it is determined that the input voltage VIN is greater than or equal to the reference voltage VIR (step S210). For example, the first comparing part 310 compares the input voltage VIN with the reference voltage VIR to output the first comparison signal CS1.

When the input voltage VIN is less than the reference voltage VIR, the deactivation of the output voltage VOUT is maintained (step S220). For example, the output voltage generating part 330 maintains the deactivation of the output voltage VOUT according to the first comparison signal CS1. The deactivation of the output voltage VOUT is maintained until the input voltage VIN is greater than or equal to the reference voltage VIR.

When the input voltage VIN is greater than or equal to the reference voltage VIR, the output voltage VOUT is activated (step S230). For example, the output voltage generating part 330 activates the output voltage VOUT according to the first comparison signal CS1.

It is determined that the input voltage VIN is greater than the first low limit voltage VIL1 (step S240). For example, the first voltage comparing part 321 of the second comparing part 320 compares the input voltage VIN with the first low limit voltage VIL1 to output the first voltage comparison signal VCS1.

When the input voltage VIN is greater than the first low limit voltage VIL1, the output voltage VOUT is activated (step S230). For example, when the input voltage VIN is greater than the first low limit voltage VIL, the activation of the output voltage VOUT is maintained, and the output voltage generating part 330 maintains the activation of the output voltage VOUT according to the second comparison signal CS2 generated based on the first voltage comparison signal VCS1.

When the input voltage VIN is less than or equal to the first low limit voltage VIL1, it is determined that the input voltage VIN is greater than the second low limit voltage VIL2 (step S250). For example, the second voltage comparing part 322 of the second comparing part 320 compares the input voltage VIN with the second low limit voltage VIL2 to output the second voltage comparison signal VCS2 when the input voltage VIN is less than or equal to the first low limit voltage VIL1 according to the first voltage comparison signal VCS1.

When the input voltage VIN is less than or equal to the first low limit voltage VIL1 and is greater than the second low limit voltage VIL2, it is determined that the elapse time is longer than or equal to the reference time RT (step S260). For example, the elapse time is a time that has elapsed since the input voltage VIN became less than or equal to the first low limit voltage VIL1, and greater than the second low limit voltage VIL2. For example, the time comparing part 323 of the second comparing part 320 compares the elapse time with the reference time RT to output the time comparison signal TCS when the input voltage VIN is less than or equal to the first low limit voltage VIL1 and is greater than the second low limit voltage VIL2 according to the first voltage comparison signal VCS1 and the second voltage comparison signal VCS2.

When the elapse time is less than the reference time RT, the output voltage VOUT is activated (step S230). For example, when the elapse time is less than the reference time RT, the activation of the output voltage VOUT is maintained, and the output voltage generating part 330 maintains the activation of the output voltage VOUT according to the second comparison signal CS2 generated based on the time comparison signal TCS.

When the elapse time is longer than or equal to the reference time RT, the output voltage VOUT is deactivated (step S270). For example, the output voltage generating part 330 deactivates the output voltage VOUT according to the second comparison signal CS2 generated based on the time comparison signal TCS.

When the input voltage VIN is less than or equal to the second low limit voltage VIL2, the output voltage VOUT is deactivated (step S270). For example, the output voltage generating part 330 deactivates the output voltage VOUT according to the second comparison signal CS2 generated based on the second voltage comparison signal VCS2, when the input voltage VIN is less than or equal to the second low limit voltage VIL2.

Figure 10:
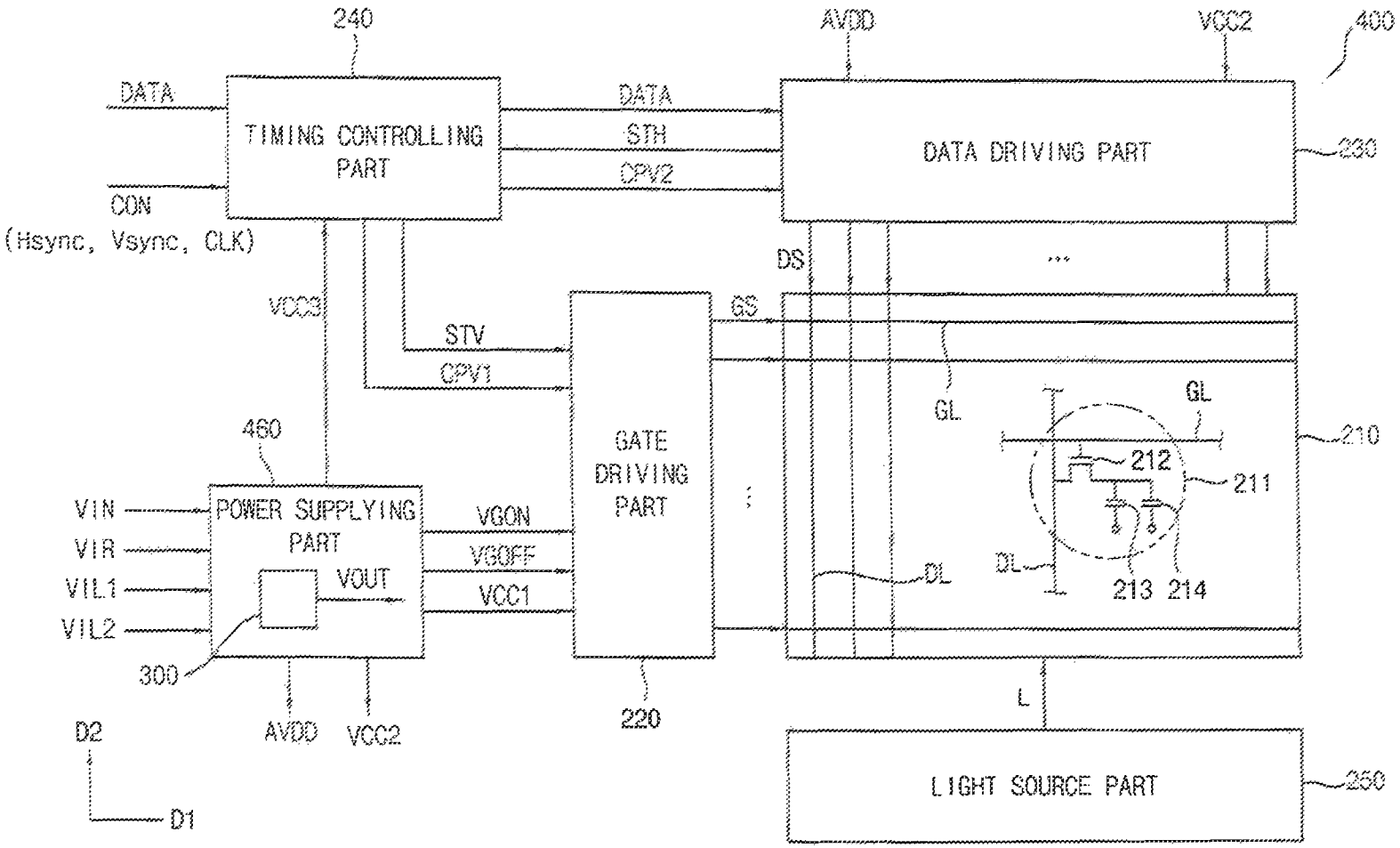
FIG. 10 is a block diagram illustrating a display apparatus including the output voltage controlling apparatus of FIG. 6.

FIG. 10 is a block diagram illustrating a display apparatus including the output voltage controlling apparatus 300 of FIG. 6.

The display apparatus 400 according to the exemplary embodiment of the present inventive concept is substantially the same as the display apparatus 200 according to the exemplary embodiment illustrated in FIG. 5 except for a power supplying part 460. Thus, the same reference numerals will be used to refer to same elements as those described in the previous exemplary embodiment and any further repetitive explanation concerning the above elements will be omitted.

Referring to FIGS. 6 and 10, the display apparatus 400 according to the exemplary embodiment of the present inventive concept includes the display panel 210, the gate driving part 220, the data driving part 230, the timing controlling part 240, the light source part 250, and the power supplying part 460.

The power supplying part 460 includes the output voltage controlling apparatus 300 of FIG. 6. Thus, the power supplying part 460 outputs the output voltage VOUT according to the input voltage VIN, the reference voltage VIR, the first low limit voltage VIL1, and the second low limit voltage VIL2. For example, the reference voltage VIR may be about 2.3 volt (V), the first low limit voltage VIL1 may be about 2.0 V, and the second low limit voltage VIL2 may be about 1.5 V.

The output voltage VOUT may include at least one of the first power voltage VCC1, the second power voltage VCC2, the third power voltage VCC3, the gate on voltage VGON, the gate off voltage VGOFF, and the analog voltage AVDD. The first power voltage VCC1 drives the gate driving part 220. The second power voltage VCC2 drives the data driving part 230. The third power voltage VCC3 drives the timing controlling part 240. The gate on voltage VGON and the gate off voltage VGOFF are applied to the gate driving part 220, and the gate driving part 220 generates the gate signal GS by using the gate on voltage VGON and the gate off voltage VGOFF. The analog voltage AVDD is applied to the data driving part 230, and the data driving part 230 generates the data signal DS by using the analog voltage AVDD.

The input voltage VIN may be less than or equal to the first low limit voltage VIL1 in a frame period. For example, the input voltage VIN may be less than or equal to the first low limit voltage VIL1 in response to the gate start signal STV applied to the gate driving part 220 in the frame period. In this case, the input voltage VIN may be less than or equal to the first low limit voltage VIL1 during a time less than the reference time RT. In addition, the input voltage VIN may be less than or equal to the first low limit voltage VIL1 due to instability of the output voltage controlling apparatus 300 or the power supplying part 460. In this case, the input voltage VIN may be less than or equal to the first low limit voltage VIL1 during a time longer than or equal to the reference time RT.

According to the exemplary embodiment of the present inventive concept, although the input voltage VIN is less than or equal to the first low limit voltage VIL1, when the elapse time is less than the reference time RT, the activation of the output voltage VOUT is maintained, and thus display quality of the display apparatus 400 may be increased. For example, the elapse time may be a time that has elapsed since the input voltage VIN became less than or equal to the first low limit voltage VIL1.

Figure 11:
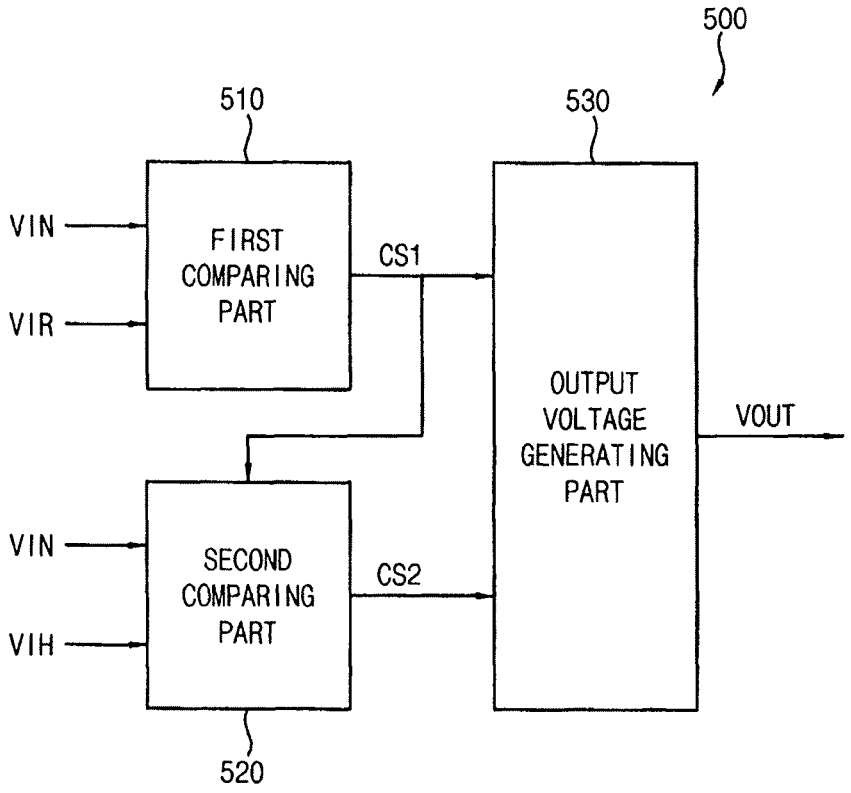
FIG. 11 is a block diagram illustrating an output voltage controlling apparatus according to an exemplary embodiment of the present inventive concept.

FIG. 11 is a block diagram illustrating an output voltage controlling apparatus according to an exemplary embodiment of the present inventive concept.

Referring to FIG. 11, the output voltage controlling apparatus 500 according to the exemplary embodiment of the present inventive concept includes a first comparing part 510, a second comparing part 520, and an output voltage generating part 530.

The first comparing part 510 compares an input voltage VIN applied from outside with a predetermined reference voltage VIR to output a first comparison signal CS1. For example, the first comparison signal CS1 may have a low level when the input voltage VIN is less than the reference voltage VIR, and the first comparison signal CS1 may have a high level when the input voltage VIN is greater than or equal to the reference voltage VIR. In addition, the first comparison signal CS1 may have a high level when the input voltage VIN is less than the reference voltage VIR, and the first comparison signal CS1 may have a low level when the input voltage VIN is greater than or equal to the reference voltage VIR.

The second comparing part 520 compares the input voltage VIN with a high limit voltage VIH, which is greater than the low limit voltage VIL or the first low limit voltage VIL1, to output a second comparison signal CS2 when the input voltage VIN is greater than or equal to the reference voltage VIR according to the first comparison signal CS1. In addition, the second comparing part 520 compares an elapse time with a reference time RT to output the second comparison signal CS2 when the input voltage VIN is greater than or equal to the high limit voltage VIH. For example, the elapse time may be a time since the input voltage VIN became greater than or equal to the high limit voltage VIH.

Figure 12:
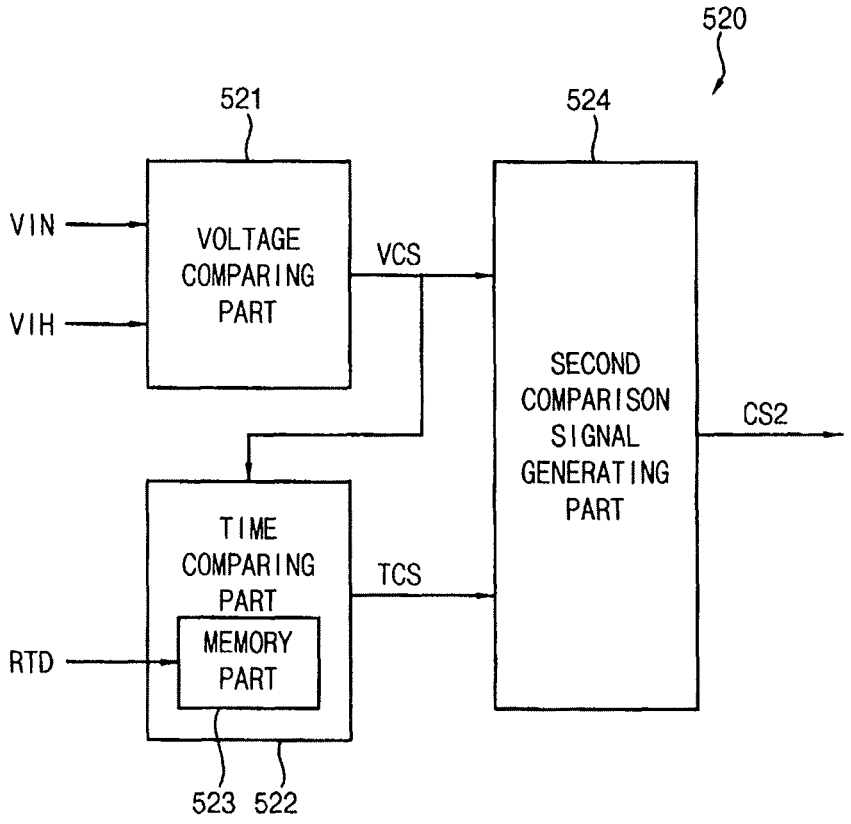
FIG. 12 is a block diagram illustrating a second comparing part of FIG. 11.

FIG. 12 is a block diagram illustrating the second comparing part 520 of FIG. 11.

Referring to FIGS. 11 and 12, the second comparing part 520 includes a voltage comparing part 521, a time comparing part 522, and a second comparison signal generating part 524.

The voltage comparing part 521 compares the input voltage VIN with the high limit voltage VIH to output a voltage comparison signal VCS. For example, the voltage comparison signal VCS may have a high level when the input voltage VIN is less than the high limit voltage VIH, and the voltage comparison signal VCS may have a low level when the input voltage VIN is greater than or equal to the high limit voltage VIH. In addition, the voltage comparison signal VCS may have a low level when the input voltage VIN is less than the high limit voltage VIH, and the voltage comparison signal VCS may have a high level when the input voltage VIN is greater than or equal to the high limit voltage VIH.

The time comparing part 522 compares the elapse time with the reference time RT to output a time comparison signal TCS when the input voltage VIN is greater than or equal to the high limit voltage VIH according to the voltage comparison signal VCS. For example, the elapse time may be a time that has elapsed since the input voltage VIN became greater than or equal to the high limit voltage VIH. For example, the time comparison signal TCS may have a low level when the elapse time is longer than or equal to the reference time RT, and the time comparison signal TCS may have a high level when the elapse time is less than the reference time RT. In addition, the time comparison signal TCS may have a high level when the elapse time is longer than or equal to the reference time RT, and the time comparison signal TCS may have a low level when the elapse time is less than the reference time RT.

The time comparing part 522 may further include a memory part 523 for storing a reference time data RTD which is data of the reference time RT. For example, the memory part 523 may be an electrically erasable programmable read only memory (EEPROM). The reference time data RTD may be stored in the memory part 523 with 2 bits. For example, the reference time data RTD may be '00' when the reference time RT is about 0 μs, the reference time data RTD may be '01' when the reference time RT is about 10 μs, the reference time data RTD may be '10' when the reference time RT is about 50 μs, and the reference time data RTD may be '11' when the reference time RT is about 100 μs.

The second comparison signal generating part 524 generates the second comparison signal CS2 according to the voltage comparison signal VCS and the time comparison signal TCS. For example, the second comparison signal CS2 may have a high level when the voltage comparison signal VCS has a high level. In addition, the second comparison signal CS2 may have a high level when the voltage comparison signal VCS has a low level and the time comparison signal TCS has a high level. In addition, the second comparison signal CS2 may have a low level when the voltage comparison signal VCS has a low level and the time comparison signal TCS has a low level.

Referring back to FIG. 11, the output voltage generating part 530 generates an output voltage VOUT according to the first comparison signal CS1 and the second comparison signal CS2. For example, the output voltage generating part 530 activates the output voltage VOUT when the input voltage VIN is greater than or equal to the reference voltage VIR according to the first comparison signal CS1. In addition, the output voltage generating part 530 maintains an activation of the output voltage VOUT when the input voltage VIN is less than the high limit voltage VIH according to the second comparison signal CS2. In addition, the output voltage generating part 530 maintains the activation of the output voltage VOUT when the input voltage VIN is greater than or equal to the high limit voltage VIH and the elapse time is less than the reference time RT according to the second comparison signal CS2. For example, the elapse time may be a time that has elapsed since the input voltage VIN became greater than or equal to the high limit voltage VIH. In addition, the output voltage generating part 530 deactivates the output voltage VOUT when the input voltage VIN is greater than or equal to the high limit voltage VIH and the elapse time is longer than or equal to the reference time RT according to the second comparison signal CS2.

Figure 13:
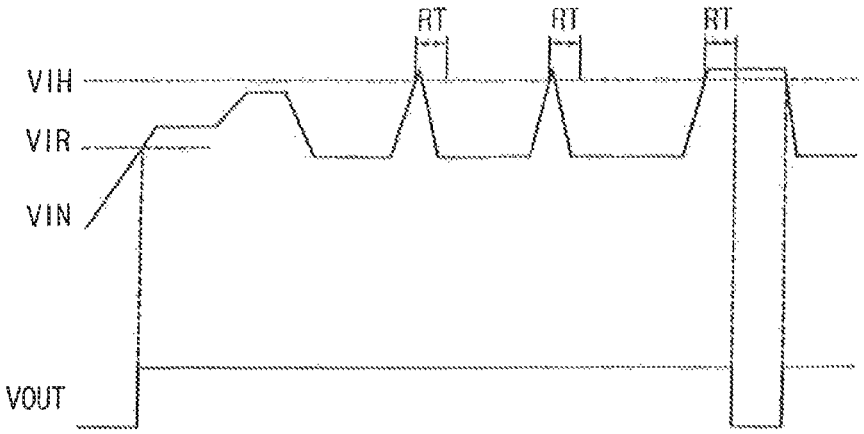
FIG. 13 is a waveform diagram illustrating an input voltage, a reference voltage, a high limit voltage and an output voltage of FIGS. 11 and 12.

FIG. 13 is a waveform diagram illustrating the input voltage VIN, the reference voltage VIR, the high limit voltage VIH, and the output voltage VOUT of FIGS. 11 and 12.

Referring to FIGS. 11 to 13, when the input voltage VIN is greater than or equal to the reference voltage VIR, the output voltage VOUT is activated. The input voltage VIN and the reference voltage VIR may be compared by the first comparing part 510. In addition, the output voltage VOUT may be activated by the output voltage generating part 530. When the input voltage VIN is less than the reference voltage VIR, a deactivation of the output voltage VOUT is maintained. The deactivation of the output voltage VOUT may be maintained by the output voltage generating part 530.

After the output voltage VOUT is activated, when the input voltage VIN is less than the high limit voltage VIH, the activation of the output voltage VOUT is maintained. The input voltage VIN and the high limit voltage VIH may be compared by the voltage comparing part 521 of the second comparing part 520. In addition, the activation of the output voltage VOUT may be maintained by the output voltage generating part 530.

After the output voltage VOUT is activated, when the input voltage VIN is greater than or equal to the high limit voltage VIH, the elapse time and the reference time RT are compared. For example, the elapse time may be a time that has elapsed since the input voltage VIN became greater than or equal to the high limit voltage VIH. When the elapse time is less than the reference time RT, the activation of the output voltage VOUT is maintained. The elapse time and the reference time RT may be compared by the time comparing part 522 of the second comparing part 520. In addition, the activation of the output voltage VOUT may be maintained by the output voltage generating part 530. When the elapse time is longer than or equal to the reference time RT, the output voltage VOUT is deactivated. The output voltage VOUT may be deactivated by the output voltage generating part 530.

Figure 14:
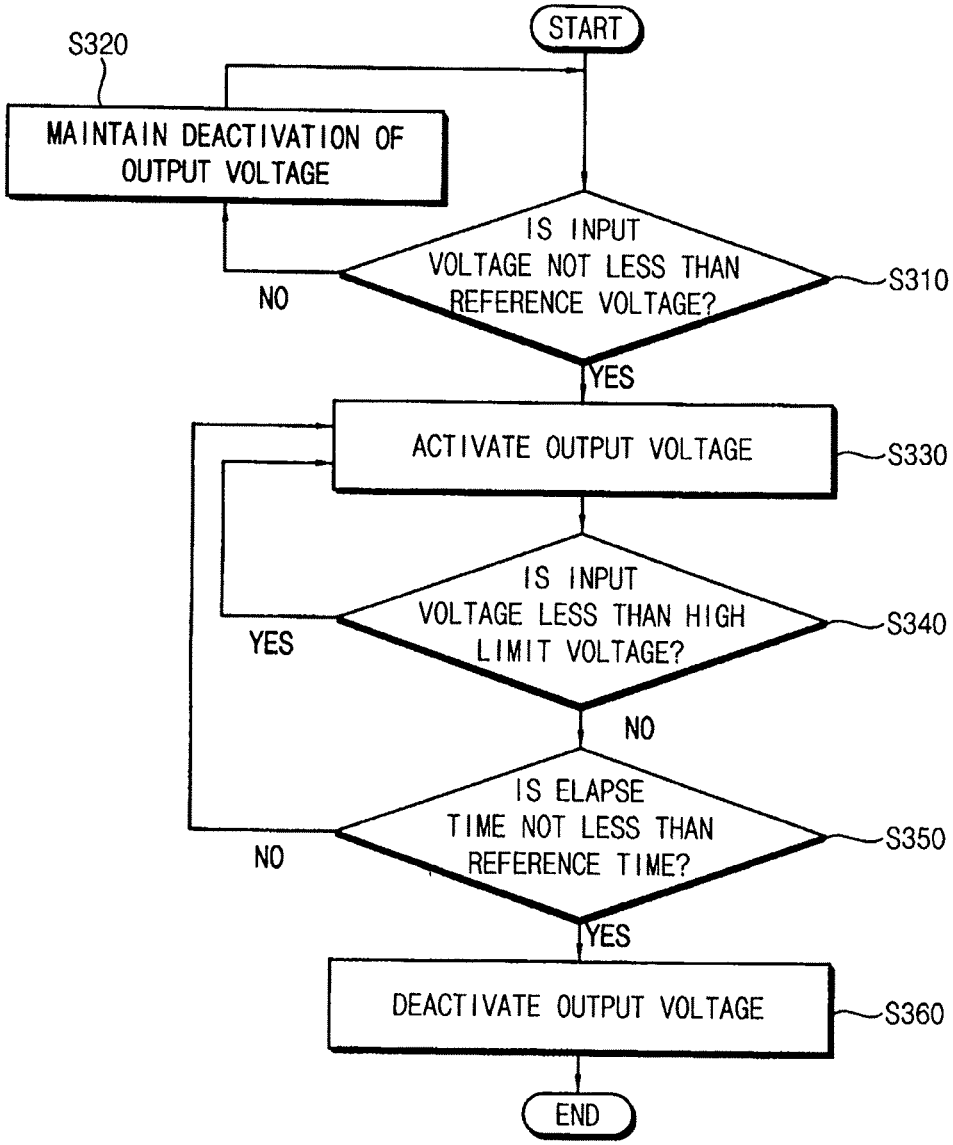
FIG. 14 is a flow chart illustrating a method of controlling an output voltage by using the output voltage controlling apparatus of FIG. 11.

FIG. 14 is a flow chart illustrating a method of controlling output voltage VOUT by using the output voltage controlling apparatus 500 of FIG. 11.

Referring to FIGS. 11 to 14, it is determined that the input voltage VIN is greater than or equal to the reference voltage VIR (step S310). For example, the first comparing part 510 compares the input voltage VIN with the reference voltage VIR to output the first comparison signal CS1.

When the input voltage VIN is less than the reference voltage VIR, the deactivation of the output voltage VOUT is maintained (step S320). For example, the output voltage generating part 530 maintains the deactivation of the output voltage VOUT according to the first comparison signal CS1. The deactivation of the output voltage VOUT is maintained until the input voltage VIN is greater than or equal to the reference voltage VIR.

When the input voltage VIN is greater than or equal to the reference voltage VIR, the output voltage VOUT is activated (step S330). For example, the output voltage generating part 530 activates the output voltage VOUT according to the first comparison signal CS1.

It is determined that the input voltage VIN is less than the high limit voltage VIH (step S340). For example, the voltage comparing part 521 of the second comparing part 520 compares the input voltage VIN with the high limit voltage VIH to output the voltage comparison signal VCS.

When the input voltage VIN is less than the high limit voltage VIH, the output voltage VOUT is activated (step S330). For example, when the input voltage VIN is less than the high limit voltage VIH, the activation of the output voltage VOUT is maintained, and the output voltage generating part 530 maintains the activation of the output voltage VOUT according to the second comparison signal CS2 generated based on the voltage comparison signal VCS.

When the input voltage VIN is greater than or equal to the high limit voltage VIH, it is determined that the elapse time is longer than or equal to the reference time RT (step S350). For example, the elapse time may be a time that has elapsed since the input voltage VIN became greater than or equal to the high limit voltage VIH. For example, the time comparing part 522 of the second comparing part 520 compares the elapse time with the reference time RT to output the time comparison signal TCS when the input voltage VIN is greater than or equal to the high limit voltage VIH according to the voltage comparison signal VCS.

When the elapse time is less than the reference time RT, the output voltage VOUT is activated (step S330). For example, when the elapse time is less than the reference time RT, the activation of the output voltage VOUT is maintained, and the output voltage generating part 530 maintains the activation of the output voltage VOUT according to the second comparison signal CS2 generated based on the time comparison signal TCS.

When the elapse time is longer than or equal to the reference time RT, the output voltage VOUT is deactivated (step S360). For example, the output voltage generating part 530 deactivates the output voltage VOUT according to the second comparison signal CS2 generated based on the time comparison signal TCS.

Figure 15:
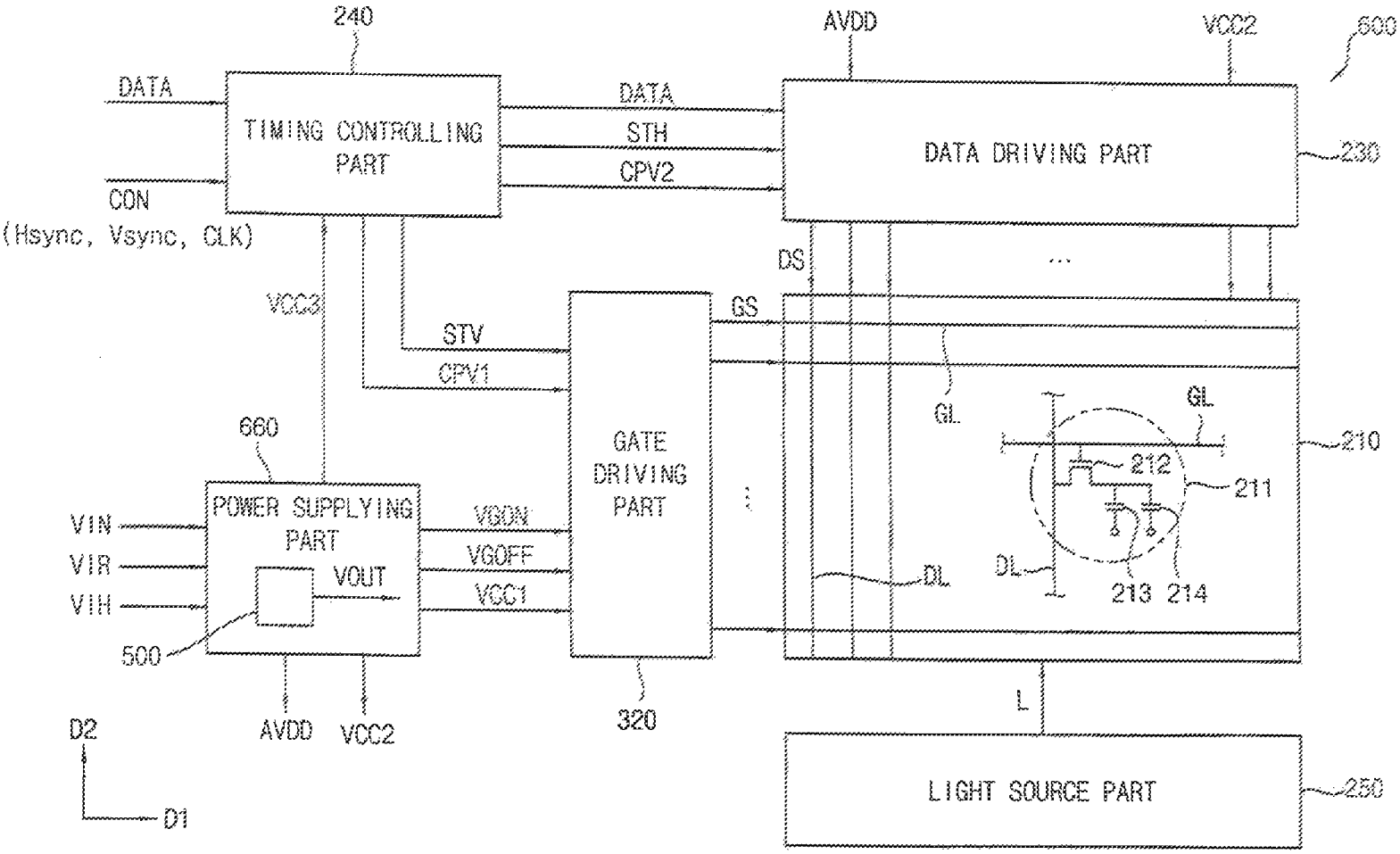
FIG. 15 is a block diagram illustrating a display apparatus including the output voltage controlling apparatus of FIG. 11.

FIG. 15 is a block diagram illustrating a display apparatus including the output voltage controlling apparatus 500 of FIG. 11.

The display apparatus 600 according to the exemplary embodiment of the present inventive concept is substantially the same as the display apparatus 200 according to the exemplary embodiment illustrated in FIG. 5 except for a power supplying part 660. Thus, the same reference numerals will be used to refer to same elements as those described in the previous exemplary embodiment and any further repetitive explanation concerning the above elements will be omitted.

Referring to FIGS. 11 and 15, the display apparatus 600 according to the exemplary embodiment of the present inventive concept includes the display panel 210, the gate driving part 220, the data driving part 230, the timing controlling part 240, the light source part 250, and the power supplying part 660.

The power supplying part 660 includes the output voltage controlling apparatus 500 of FIG. 11. Thus, the power supplying part 660 outputs the output voltage VOUT according to the input voltage VIN, the reference voltage VIR, and the high limit voltage VIH. For example, the reference voltage VIR may be about 2.3 volt (V), and the high limit voltage VIH may be about 2.6 V.

The output voltage VOUT may include at least one of the first power voltage VCC1, the second power voltage VCC2, the third power voltage VCC3, the gate on voltage VGON, the gate off voltage VGOFF, and the analog voltage AVDD. The first power voltage VCC1 drives the gate driving part 220. The second power voltage VCC2 drives the data driving part 230. The third power voltage VCC3 drives the timing controlling part 240. The gate on voltage VGON and the gate off voltage VGOFF are applied to the gate driving part 220, and the gate driving part 220 generates the gate signal GS by using the gate on voltage VGON and the gate off voltage VGOFF. The analog voltage AVDD is applied to the data driving part 230, and the data driving part 230 generates the data signal DS by using the analog voltage AVDD.

The input voltage VIN may be greater than or equal to the high limit voltage VIH in a frame period. For example, the input voltage VIN may be greater than or equal to the high limit voltage VIH in response to the gate start signal STV applied to the gate driving part 220 in the frame period. In this case, the input voltage VIN may be greater than or equal to the high limit voltage VIH during a time less than the reference time RT. In addition, the input voltage VIN may be greater than or equal to the high limit voltage VIH due to instability of at least one of the output voltage controlling apparatus 500, the power supplying part 660 or the display apparatus 600. In this case, the input voltage VIN may be greater than or equal to the high limit voltage VIH during a time longer than or equal to the reference time RT.

According to the exemplary embodiment of the present inventive concept, although the input voltage VIN is greater than or equal to the high limit voltage VIH, when the elapse time is less than the reference time RT, the activation of the output voltage VOUT is maintained, therefore the output voltage VOUT is not deactivated in the initial period when the power supplying part 860 is driven, and thus display quality of the display apparatus 600 may be increased.

Figure 16:
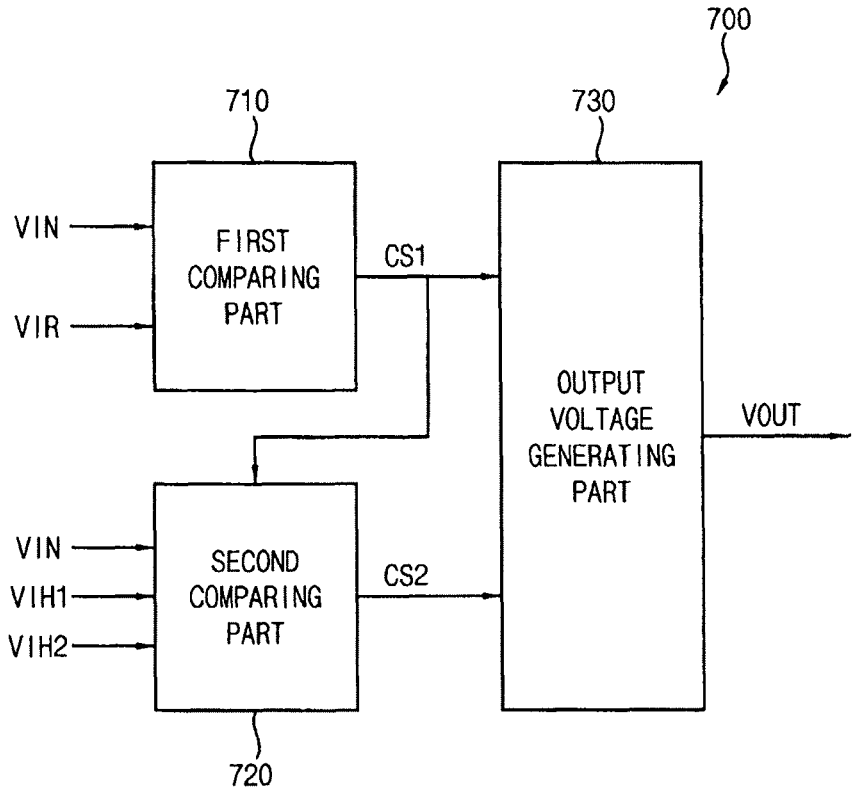
FIG. 16 is a block diagram illustrating an output voltage controlling apparatus according to an exemplary embodiment of the present inventive concept.

FIG. 16 is a block diagram illustrating an output voltage controlling apparatus according to an exemplary embodiment of the present inventive concept.

Referring to FIG. 16, the output voltage controlling apparatus 700 according to the exemplary embodiment of the present inventive concept includes a first comparing part 710, a second comparing part 720, and an output voltage generating part 730.

The first comparing part 710 compares an input voltage VIN applied from outside with a predetermined reference voltage VIR to output a first comparison signal CS1. For example, the first comparison signal CS1 may have a low level when the input voltage VIN is less than the reference voltage VIR, and the first comparison signal CS1 may have a high level when the input voltage VIN is greater than or equal to the reference voltage VIR. In addition, the first comparison signal CS1 may have a high level when the input voltage VIN is less than the reference voltage VIR, and the first comparison signal CS1 may have a low level when the input voltage VIN is greater than or equal to the reference voltage VIR.

The second comparing part 720 compares the input voltage VIN with a first high limit voltage VIH1 and compares the input voltage VIN with a second high limit voltage VIH2 to output a second comparison signal CS2 when the input voltage VIN is greater than or equal to the reference voltage VIR according to the first comparison signal CS1. The second high limit voltage VIH2 is greater than the first high limit voltage VIH1. In addition, the second comparing part 720 compares an elapse time with a reference time RT to output the second comparison signal CS2 when the input voltage VIN is greater than or equal to the first high limit voltage VIH1 and is less than the second high limit voltage VIH2. For example, the elapse time may be a time that has elapsed since the input voltage VIN became greater than or equal to the first high limit voltage VIH1, and less than the second high limit voltage VIH2.

Figure 17:
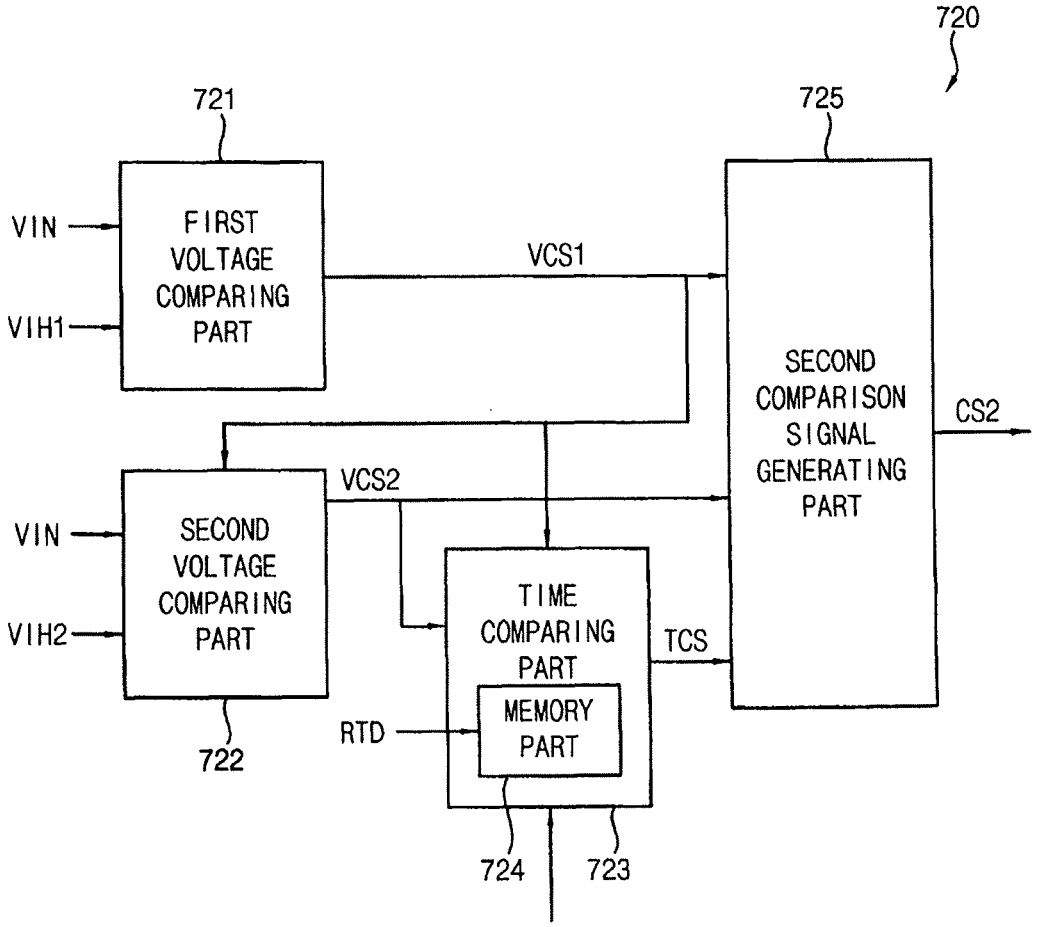
FIG. 17 is a block diagram illustrating a second comparing part of FIG. 16.

FIG. 17 is a block diagram illustrating the second comparing part 720 of FIG. 16.

Referring to FIGS. 16 and 17, the second comparing part 720 includes a first voltage comparing part 721, a second voltage comparing part 722, a time comparing part 723, and a second comparison signal generating part 725.

The first voltage comparing part 721 compares the input voltage VIN with the first high limit voltage VIH1 to output a first voltage comparison signal VCS1. For example, the first voltage comparison signal VCS1 may have a high level when the input voltage VIN is less than the first high limit voltage VIH1, and the first voltage comparison signal VCS1 may have a low level when the input voltage VIN is greater than or equal to the first high limit voltage VIH1. In addition, the first voltage comparison signal VCS1 may have a low level when the input voltage VIN is less than the first high limit voltage VIH1, and the first voltage comparison signal VCS1 may have a high level when the input voltage VIN is greater than or equal to the first high limit voltage VIH1.

The second voltage comparing part 722 compares the input voltage VIN with the second high limit voltage VIH2 to output a second voltage comparison signal VCS2 when the input voltage VIN is greater than or equal to the first high limit voltage VIH1 according to the first voltage comparison signal VCS1. For example, the second voltage comparison signal VCS2 may have a high level when the input voltage VIN is less than the second high limit voltage VIH2, and the second voltage comparison signal VCS2 may have a low level when the input voltage VIN is greater than or equal to the second high limit voltage VIH2. In addition, the second voltage comparison signal VCS2 may have a low level when the input voltage VIN is less than the second high limit voltage VIH2, and the second voltage comparison signal VCS2 may have a high level when the input voltage VIN is greater than or equal to the second high limit voltage VIH2.

The time comparing part 723 compares the elapse time with the reference time RT to output a time comparison signal TCS when the input voltage VIN is greater than or equal to the first high limit voltage VIH1 and is less than the second high limit voltage VIH2 according to the first voltage comparison signal VCS1 and the second voltage comparison signal VCS2. For example, the elapse time may be a time that has elapsed since the input voltage VIN became greater than or equal to the first high limit voltage VIH1, and less than the second high limit voltage VIH2. For example, the time comparison signal TCS may have a low level when the elapse time is longer than or equal to the reference time RT, and the time comparison signal TCS may have a high level when the elapse time is less than the reference time RT. In addition, the time comparison signal TCS may have a high level when the elapse time is longer than or equal to the reference time RT, and the time comparison signal TCS may have a low level when the elapse time is less than the reference time RT.

The time comparing part 723 may further include a memory part 724 for storing a reference time data RTD which is data of the reference time RT. For example, the memory part 724 may be an electrically erasable programmable read only memory (EEPROM). The reference time data RTD may be stored in the memory part 724 with 2 bits. For example, the reference time data RTD may be '00' when the reference time RT is about 0 μs, the reference time data RTD may be '01' when the reference time RT is about 10 μs, the reference time data RTD may be '10' when the reference time RT is about 50 μs, and the reference time data RTD may be '11' when the reference time RT is about 100 μs.

The second comparison signal generating part 725 generates the second comparison signal CS2 according to the first voltage comparison signal VCS1, the second voltage comparison signal VCS2 and the time comparison signal TCS. For example, the second comparison signal CS2 may have a high level when the first voltage comparison signal VCS1 has a high level. In addition, the second comparison signal CS2 may have a low level when the second voltage comparison signal VCS2 has a low level. In addition, the second comparison signal CS2 may have a high level when the first voltage comparison signal VCS1 has a low level, the second voltage comparison signal VCS2 has a high level, and the time comparison signal TCS has a high level. In addition, the second comparison signal CS2 may have a low level when the first voltage comparison signal VCS1 has a low level, the second voltage comparison signal VCS2 has a high level, and the time comparison signal TCS has a low level.

Referring back to FIG. 16, the output voltage generating part 730 generates an output voltage VOUT according to the first comparison signal CS1 and the second comparison signal CS2. For example, the output voltage generating part 730 activates the output voltage VOUT when the input voltage VIN is greater than or equal to the reference voltage VIR according to the first comparison signal CS1. In addition, the output voltage generating part 730 maintains an activation of the output voltage VOUT, when the input voltage VIN is less than the first high limit voltage VIH1 according to the second comparison signal CS2. In addition, the output voltage generating part 730 maintains the activation of the output voltage VOUT, when the input voltage VIN is greater than or equal to the first high limit voltage VIH1, the input voltage VIN is less than the second high limit voltage VIH2 and the elapse time is less than the reference time RT according to the second comparison signal CS2. For example, the elapse time may be a time that has elapsed since the input voltage VIN became less than the second high limit voltage VIH2. In addition, the output voltage generating part 730 deactivates the output voltage VOUT when the input voltage VIN is greater than or equal to the first low limit voltage VIH1, the input voltage VIN is less than the second high limit voltage VIH2, and the elapse time is longer than or equal to the reference time RT according to the second comparison signal CS2. For example, the elapse time may be a time that has elapsed since the input voltage VIN became greater than or equal to the first low limit voltage VIH1, and less than the second high limit voltage VIH2. In addition, the output voltage generating part 730 deactivates the output voltage VOUT when the input voltage VIN is greater than or equal to the second high limit voltage VIH2 according to the second comparison signal CS2.

Figure 18:
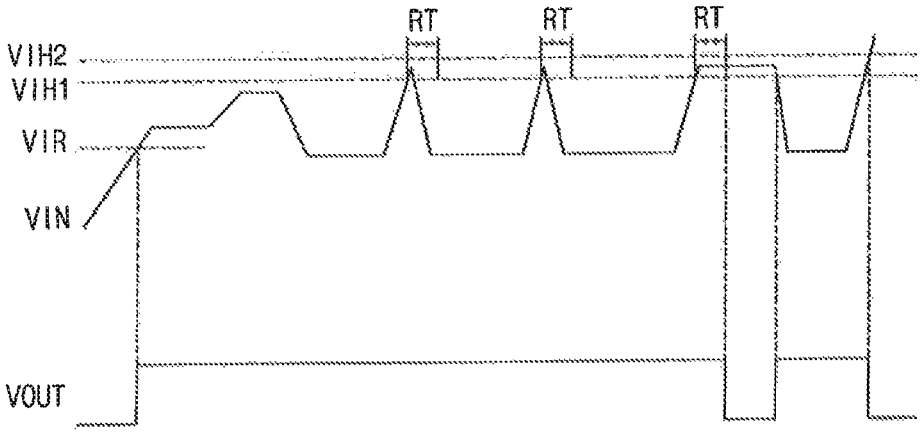
FIG. 18 is a waveform diagram illustrating an input voltage, a reference voltage, a first high limit voltage, a second high limit voltage and an output voltage of FIGS. 16 and 17.

FIG. 18 is a waveform diagram illustrating the input voltage VIN, the reference voltage VIR, the first high limit voltage VIH1, the second high limit voltage VIH2, and the output voltage VOUT of FIGS. 16 and 17.

Referring to FIGS. 16 to 18, when the input voltage VIN is greater than or equal to the reference voltage VIR, the output voltage VOUT is activated. The input voltage VIN and the reference voltage VIR may be compared by the first comparing part 710. In addition, the output voltage VOUT may be activated by the output voltage generating part 730. When the input voltage VIN is less than the reference voltage VIR, a deactivation of the output voltage VOUT is maintained. The deactivation of the output voltage VOUT may be maintained by the output voltage generating part 730.

After the output voltage VOUT is activated, when the input voltage VIN is less than the first high limit voltage VIH1, the activation of the output voltage VOUT is maintained. The input voltage VIN and the first high limit voltage VIH1 may be compared by the first voltage comparing part 721 of the second comparing part 720. In addition, the activation of the output voltage VOUT may be maintained by the output voltage generating part 730.

After the output voltage VOUT is activated, when the input voltage VIN is greater than or equal to the first high limit voltage VIH1 and the input voltage VIN is less than the second high limit voltage VIH2, the elapse time and the reference time RT are compared. For example, the elapse time is a time that has elapsed since the input voltage VIN became greater than or equal to the first low limit voltage VIH1, and less than the second high limit voltage VIH2. When the elapse time is less than the reference time RT, the activation of the output voltage VOUT is maintained. The input voltage VIN and the second high limit voltage VIH2 may be compared by the second voltage comparing part 722 of the second comparing part 720. In addition, the elapse time and the reference time RT may be compared by the time comparing part 722 of the second comparing part 720. In addition, the activation of the output voltage VOUT may be maintained by the output voltage generating part 730. When the elapse time is longer than or equal to the reference time RT, the output voltage VOUT is deactivated. The output voltage VOUT may be deactivated by the output voltage generating part 730.

After the output voltage VOUT is activated, when the input voltage VIN is greater than or equal to the second high limit voltage VIH2, the output voltage VOUT is deactivated. The output voltage VOUT may be deactivated by the output voltage generating part 730.

Figure 19:
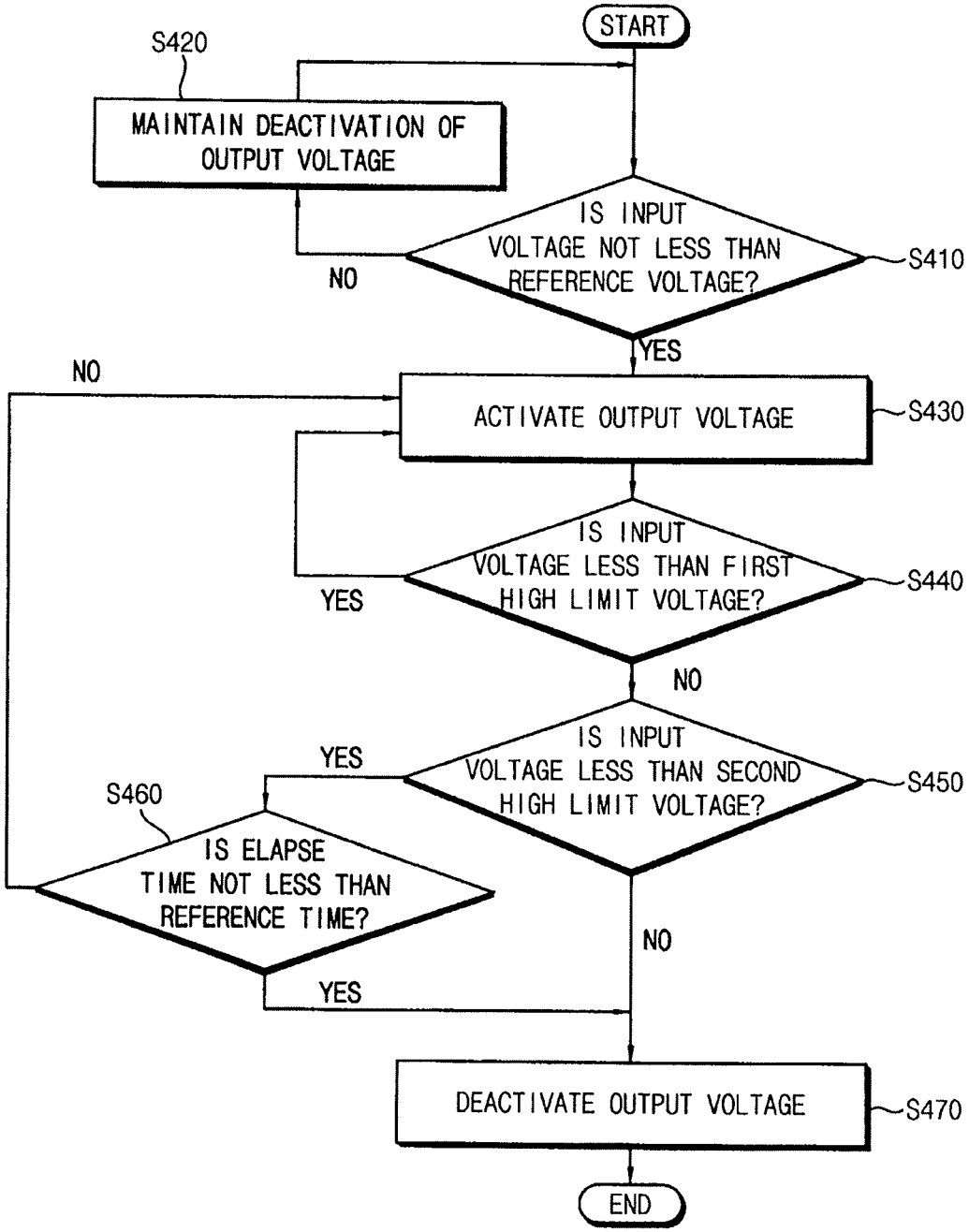
FIG. 19 is a flow chart illustrating a method of controlling output voltage by using the output voltage controlling apparatus of FIG. 16.

FIG. 19 is a flow chart illustrating a method of controlling output voltage VOUT by using the output voltage controlling apparatus 700 of FIG. 16.

Referring to FIGS. 16 to 19, it is determined that the input voltage VIN is greater than or equal to the reference voltage VIR (step S410). For example, the first comparing part 710 compares the input voltage VIN with the reference voltage VIR to output the first comparison signal CS1.

When the input voltage VIN is less than the reference voltage VIR, the deactivation of the output voltage VOUT is maintained (step S420). For example, the output voltage generating part 730 maintains the deactivation of the output voltage VOUT according to the first comparison signal CS1.

The deactivation of the output voltage VOUT is maintained until the input voltage VIN is greater than or equal to the reference voltage VIR.

When the input voltage VIN is greater than or equal to the reference voltage VIR, the output voltage VOUT is activated (step S430). For example, the output voltage generating part 730 activates the output voltage VOUT according to the first comparison signal CS1.

It is determined that the input voltage VIN is less than the first high limit voltage VIH1 (step S440). For example, the first voltage comparing part 721 of the second comparing part 720 compares the input voltage VIN with the first high limit voltage VIH1 to output the first voltage comparison signal VCS1.

When the input voltage VIN is less than the first high limit voltage VIH1, the output voltage VOUT is activated (step S430). For example, when the input voltage VIN is less than the first high limit voltage VIH, the activation of the output voltage VOUT is maintained, and the output voltage generating part 730 maintains the activation of the output voltage VOUT according to the second comparison signal CS2 generated based on the first voltage comparison signal VCS1.

When the input voltage VIN is greater than or equal to the first high limit voltage VIH1, it is determined that the input voltage VIN is less than the second high limit voltage VIH2 (step S450). For example, the second voltage comparing part 722 of the second comparing part 720 compares the input voltage VIN with the second high limit voltage VIH2 to output the second voltage comparison signal VCS2 when the input voltage VIN is greater than or equal to the first high limit voltage VIH1 according to the first voltage comparison signal VCS1.

When the input voltage VIN is greater than or equal to the first high limit voltage VIH1 and is less than the second high limit voltage VIH2, it is determined that the elapse time is longer than or equal to the reference time RT (step S460). For example, the elapse time may be a time that has elapsed since the input voltage VIN became greater than or equal to the first high limit voltage VIH1, and less than the second high limit voltage VIH2. For example, the time comparing part 723 of the second comparing part 720 compares the elapse time with the reference time RT to output the time comparison signal TCS when the input voltage VIN is greater than or equal to the first high limit voltage VIH1 and is less than the second high limit voltage VIH2 according to the first voltage comparison signal VCS1 and the second voltage comparison signal VCS2.

When the elapse time is less than the reference time RT, the output voltage VOUT is activated (step S430). For example, when the elapse time is less than the reference time RT, the activation of the output voltage VOUT is maintained, and the output voltage generating part 730 maintains the activation of the output voltage VOUT according to the second comparison signal CS2 generated based on the time comparison signal TCS.

When the elapse time is longer than or equal to the reference time RT, the output voltage VOUT is deactivated (step S270). For example, the output voltage generating part 730 deactivates the output voltage VOUT according to the second comparison signal CS2 generated based on the time comparison signal TCS.

Figure 20:
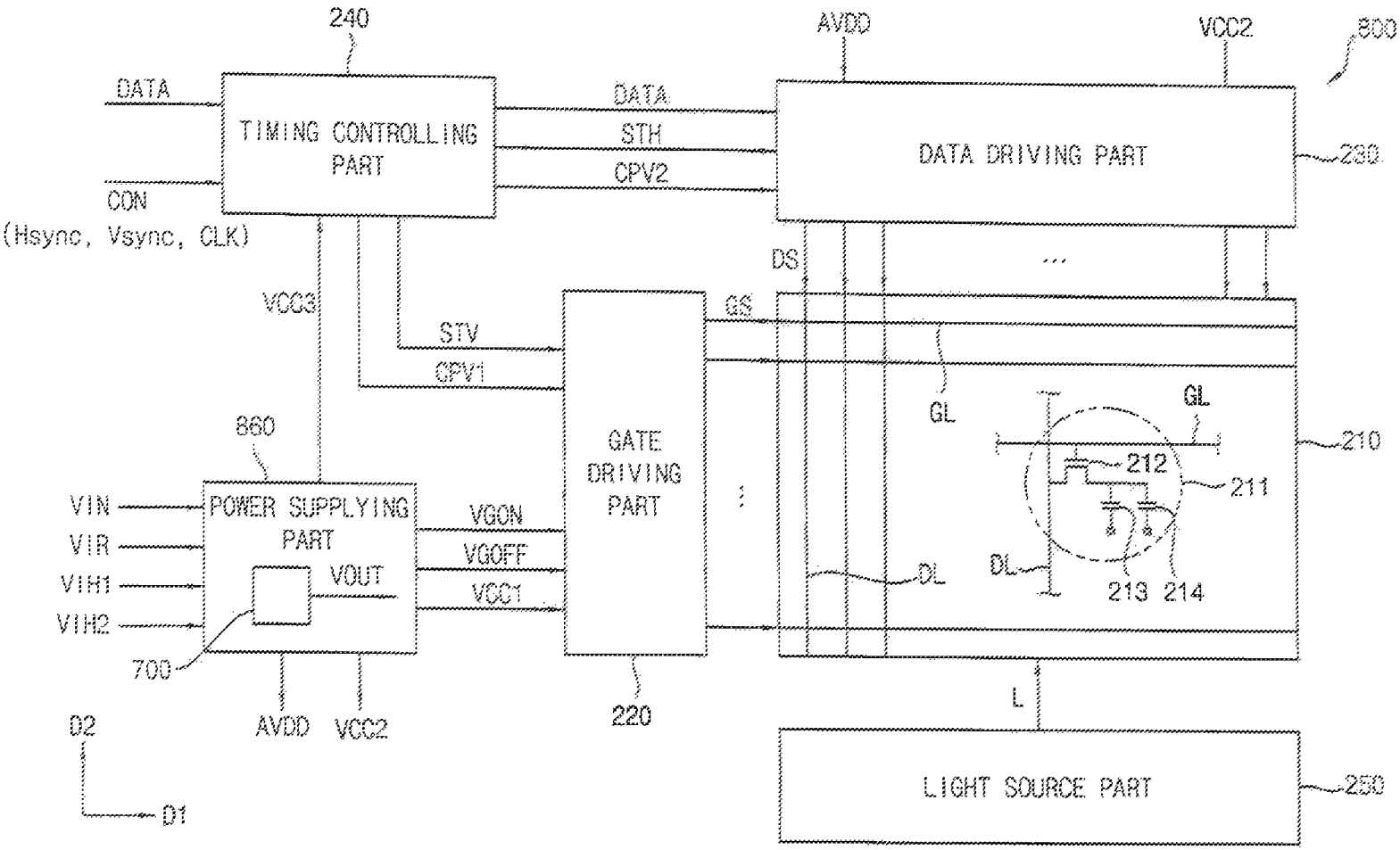
FIG. 20 is a block diagram illustrating a display apparatus including the output voltage controlling apparatus of FIG. 16.

FIG. 20 is a block diagram illustrating a display apparatus including the output voltage controlling apparatus 700 of FIG. 16.

The display apparatus 800 according to the exemplary embodiment of the present inventive concept is substantially the same as the display apparatus 200 according to the previous exemplary embodiment illustrated in FIG. 5 except for a power supplying part 860. Thus, the same reference numerals will be used to refer to same elements as those described in the previous exemplary embodiment and any further repetitive explanation concerning the above elements will be omitted.

Referring to FIGS. 16 and 20, the display apparatus 800 according to the exemplary embodiment of the present inventive concept includes the display panel 210, the gate driving part 220, the data driving part 230, the timing controlling part 240, the light source part 250, and the power supplying part 860.

The power supplying part 860 includes the output voltage controlling apparatus 700 of FIG. 16. Thus, the power supplying part 860 outputs the output voltage VOUT according to the input voltage VIN, the reference voltage VIR, the first high limit voltage VIH1, and the second high limit voltage VIH2. For example, the reference voltage VIR may be about 2.3 volt (V), the first high limit voltage VIH1 may be about 2.6 V, and the second high limit voltage VIH2 may be about 3.1 V.

The output voltage VOUT may include at least one of the first power voltage VCC1, the second power voltage VCC2, the third power voltage VCC3, the gate on voltage VGON, the gate off voltage VGOFF and the analog voltage AVDD. The first power voltage VCC1 drives the gate driving part 220. The second power voltage VCC2 drives the data driving part 230. The third power voltage VCC3 drives the timing controlling part 240. The gate on voltage VGON and the gate off voltage VGOFF are applied to the gate driving part 220, and the gate driving part 220 generates the gate signal GS by using the gate on voltage VGON and the gate off voltage VGOFF. The analog voltage AVDD is applied to the data driving part 230, and the data driving part 230 generates the data signal DS by using the analog voltage AVDD.

The input voltage VIN may be greater than or equal to the first high limit voltage VIH1 in an initial period when the power supplying part 860 is driven. In this case, the input voltage VIN may be greater than or equal to the first high limit voltage VIH1 during a time less than the reference time RT. In addition, the input voltage VIN may be greater than or equal to the first high limit voltage VIH1 due to instability of at least one of the output voltage controlling apparatus 700, the power supplying part 860, and the display apparatus 800. In this case, the input voltage VIN may be greater than or equal to the first high limit voltage VIH1 during a time longer than or equal to the reference time RT.

According to the exemplary embodiment of the present inventive concept, although the input voltage VIN is greater than or equal to the first high limit voltage VIH1, when the elapse time is less than the reference time RT, the activation of the output voltage VOUT is maintained, therefore the output voltage VOUT is not deactivated in the initial period when the power supplying part 860 is driven. Thus, display quality of the display apparatus 800 may be increased. For example, the elapse time may be a time that has elapsed since the input voltage VIN became greater than or equal to the first high limit voltage VIH1.

In the method of controlling output voltage, the output voltage controlling apparatus for performing the method, and a display apparatus having the output voltage controlling apparatus according to exemplary embodiments of the present inventive concept, although an input voltage is less than or equal to a low limit voltage, when an elapse time is less than a reference time RT, an activation of an output voltage is maintained. Thus, display quality of the display apparatus may be increased. For example, the elapse time may be a time that has elapsed since the input voltage became less than or equal to the low limit voltage.

Although the present inventive concept has been described with reference to exemplary embodiments thereof, it will be understood that the foregoing is illustrative of the present inventive concept and may not to be construed as limited to the disclosed exemplary embodiments and modifications are included within the spirit and scope of the appended claims.

What is claimed is:

1. A method of controlling an output voltage of an apparatus, the method comprising:

comparing an input voltage of the apparatus with a reference voltage;

activating the output voltage when the input voltage is greater than or equal to the reference voltage;

comparing the input voltage with a first low limit voltage or a first high limit voltage greater than the first low limit voltage;

comparing a first elapse time with a reference time when the input voltage is less than or equal to the first low limit voltage, wherein the first elapse time is an amount of time the input voltage is less than or equal to the first low limit voltage;

comparing a second elapse time with the reference time when the input voltage is greater than or equal to the first high limit voltage, wherein the second elapse time is an amount of time the input voltage is greater than or equal to the first high limit voltage;

deactivating the output voltage when the first elapse time or the second elapse time is longer than or equal to the reference time, wherein the output voltage is decreased from a high level to a low level when the first elapse time or the second elapse time is longer than or equal to the reference time;

maintaining the activation of the output voltage until the first elapse time reaches the reference time; and maintaining the activation of the output voltage until the second elapse time reaches the reference time.

2. The method of claim 1, further comprising:

maintaining the activation of the output voltage when the input voltage is greater than the first low limit voltage and less than the first high limit voltage.

3. The method of claim 1, further comprising:

deactivating the output voltage when the input voltage is less than or equal to a second low limit voltage less than the first low limit voltage.

4. The method of claim 3, further comprising:

comparing a third elapse time with the reference time when the input voltage is greater than the second low limit voltage, and less than or equal to the first low limit voltage, wherein the third elapse time is an amount of time the input voltage is greater than the second low limit voltage, and less than or equal to the first low limit voltage; and deactivating the output voltage when the third elapse time is longer than or equal to the reference time.

5. The method of claim 4, further comprising:

maintaining the activation of the output voltage when the third elapse time is less than the reference time.

6. The method of claim 1, further comprising:

deactivating the output voltage when the input voltage is greater than or equal to a second high limit voltage, wherein the second high limit voltage is greater than the first high limit voltage.

7. The method of claim 6, further comprising:

comparing a fourth elapse time with the reference time when the input voltage is less than the second high limit voltage, and greater than or equal to the first high limit voltage, wherein the fourth elapse time is an amount of time the input voltage is less than the second high limit voltage, and greater than or equal to the first high limit voltage; and deactivating the output voltage when the fourth elapse time is longer than or equal to the reference time.

8. The method of claim 7, further comprising:

maintaining the activation of the output voltage when the fourth elapse time is less than the reference time.

9. The method of claim 1, further comprising:

maintaining the activation of the output voltage when the first elapse time or the second elapse time is less than the reference time.

10. The method of claim 1, further comprising:

maintaining the deactivation of the output voltage when the input voltage is less than the reference voltage.

11. The method of claim 1, wherein the output voltage includes at least one of:

a first power voltage for driving a gate driving part configured to output a gate signal to a gate line of a display panel;

a second power voltage for driving a data driving part configured to output a data signal to a data line of the display panel;

a third power voltage for driving a timing controlling part configured to output a gate control signal for controlling the gate driving part and a data control signal for controlling the data driving part;

a gate on and off voltages applied to the gate driving part to generate the gate signal; and an analog voltage applied to the data driving part to generate the data signal.

12. An output voltage controlling apparatus, comprising:

a first comparing part configured to compare an input voltage of the output voltage controlling apparatus with a reference voltage;

a second comparing part configured to compare the input voltage with a first low limit voltage or a first high limit voltage when the input voltage is greater than or equal to the reference voltage, wherein the second comparing part is configured to compare a first elapse time with a reference time when the input voltage is less than or equal to the first low limit voltage, wherein the reference time is greater than zero seconds, and the second comparing part is configured to compare a second elapse time with the reference time when the input voltage is greater than or equal to the first high limit voltage; and an output voltage generating part configured to activate the output voltage when the input voltage is greater than or equal to the reference voltage, to deactivate the output voltage when the first elapse time or the second elapse time is longer than or equal to the reference time, to maintain the activation of the output voltage until the first elapse time reaches the reference time, and to maintain the activation of the output voltage until the second elapse time reaches the reference time, wherein the first elapse time is an amount of time the input voltage is less than or equal to the first low limit voltage, and the second elapse time is an amount of time the input voltage is greater than or equal to the first low limit voltage, wherein the output voltage is decreased from a high level to a low level when the first elapse time or the second elapse time is longer than or equal to the reference time.

13. The output voltage controlling apparatus of claim 12, wherein the second comparing part comprises:

a voltage comparing part configured to compare the input voltage with the first low limit voltage;

a time comparing part configured to compare the first elapse time with the reference time; and a second comparison signal generating part configured to output a comparison signal based on an output signal of the voltage comparing part and an output signal of the time comparing part.

14. The output voltage controlling apparatus of claim 12, wherein the second comparing part comprises:

a first voltage comparing part configured to compare the input voltage with the first low limit voltage;

a second voltage comparing part configured to compare the input voltage with a second low limit voltage less than the first low limit voltage when the input voltage is less than or equal to the first low limit voltage;

a time comparing part configured to compare a third elapse time with the reference time when the input voltage is less than or equal to the first low limit voltage and is greater than the second low limit voltage, wherein the third elapse time is an amount of time the input voltage is less than or equal to the first low limit voltage, and greater than the second low limit voltage; and a second comparison signal generating part configured to output a comparison signal based on output signals of the first and second voltage comparing parts, and an output signal of the time comparing part.

15. The output voltage controlling apparatus of claim 12, wherein the second comparing part comprises:

a voltage comparing part configured to compare the input voltage with the first high limit voltage;

a time comparing part configured to compare the second elapse time with the reference time when the input voltage is greater than or equal to the first high limit voltage; and a second comparison signal generating part configured to output a comparison signal based on an output signal of the voltage comparing part and an output signal of the time comparing part.

16. The output voltage controlling apparatus of claim 12, wherein the second comparing part comprises:

a first voltage comparing part configured to compare the input voltage with the first high limit voltage;

a second voltage comparing part configured to compare the input voltage with a second high limit voltage greater than the first high limit voltage when the input voltage is greater than or equal to the first high limit voltage;

a time comparing part configured to compare a fourth elapse time with the reference time when the input voltage is greater than or equal to the first high limit voltage and is less than the second high limit voltage, wherein the fourth elapse time is an amount of time the input voltage is greater than or equal to the first high limit voltage, and less than the second high limit voltage; and a second comparison signal generating part configured to output a comparison signal based on output signals of the first and second voltage comparing parts, and an output signal of the time comparing part.

17. The output voltage controlling apparatus of claim 12, wherein the output voltage generating part is configured to maintain the activation of the output voltage when the first elapse time or the second elapse time is less than the reference time.

18. A display apparatus, comprising:

a display panel configured to display an image, wherein the display panel includes a gate line and a data line;

a gate driving part configured to output a gate signal to the gate line;

a data driving part configured to output a data signal to the data line;

a timing controlling part configured to output a gate control signal for controlling the gate driving part and a data control signal for controlling the data driving part; and the output voltage controlling apparatus of claim 12.

19. The display apparatus of claim 18, wherein the output voltage generating part is configured to maintain the activation of the output voltage when the first elapse time or the second elapse time is less than the reference time.

* * * * *